US005346154A

United States Patent [19]

Mori

[11] Patent Number: 5,346,154

[45] Date of Patent: Sep. 13, 1994

[54] METHOD OF FORMING TRANSFER TAIL AND APPARATUS THEREOF

[75] Inventor: Kiyoaki Mori, Komatsu, Japan

[73] Assignee: Tsudakoma Kogya Kabushiki Kaisha, Kanazawa, Japan

[21] Appl. No.: 944,087

[22] Filed: Sep. 11, 1992

[30] Foreign Application Priority Data

Sep. 11, 1991 [JP] Japan ..... 3-258712
Sep. 19, 1991 [JP] Japan ..... 3-266975
Sep. 20, 1991 [JP] Japan ..... 3-268582

[51] Int. Cl.[5] ..... B65H 49/12
[52] U.S. Cl. ..... 242/131; 139/450
[58] Field of Search ..... 242/131, 131.1, 35.6 R; 139/450

[56] References Cited

U.S. PATENT DOCUMENTS 2,640,654 6/1953 Schweiter ..... 242/35.6 R
4,887,649 12/1989 van Mullekom ..... 139/450
5,143,125 9/1992 Tamatani et al. ..... 139/450

FOREIGN PATENT DOCUMENTS

0421362A1 4/1991 European Pat. Off. .
1-317965 12/1989 Japan .

OTHER PUBLICATIONS

English-language abstract for Japanese Patent Application P.D. No. 1-317965; Dec. 22, 1989.

*Primary Examiner*—Stanley N. Gilreath
*Attorney, Agent, or Firm*—Klarquist Sparkman Campbell Leigh & Whinston

[57] ABSTRACT

When forming a transfer tail, a pair of ends extending from a pair of weft packages supported through a supporting member by weft feeding means are moved to a working area of a knotter, and both the ends are knotted together by the knotter while each supporting member or a surface of the weft package holds intermediate portions of both the weft ends. There is provided a transfer tail formation apparatus comprising catching means for picking up the weft end extending from one package and the weft end of the other package, and the knotter for knotting both the weft ends picked up by the catching means together, wherein the catching means is arranged such that an operating portion thereof is positioned on or in the vicinity of a movement locus of the weft end extending from each package when both the weft packages are moved. A suction force of the catching means when forming the transfer tail is set as follows:

(suction force at a time of drawing the weft end) ≧
(suction force at a time of knotting the weft) >
(suction force after a time of drawing the weft end and before a time of knotting the weft)

15 Claims, 27 Drawing Sheets

METHOD OF FORMING TRANSFER TAIL AND APPARATUS THEREOF

BACKGROUND OF THE INVENTION

1. Field of the Invention

This invention relates to a method and apparatus for forming a transfer tail between a pair of mutually adjacent weft packages which are supported by weft feeding means disposed in the vicinity of a weaving machine so as to feed weft to the weaving machine.

2. Description of the Prior Art

In order to successively feed weft to a weaving machine, one tail end and the other leading end are sometimes connected with each other in a pair of adjacent weft packages which are movably supported by the weft feeding means. The connecting point of these wefts is referred to as transfer tail.

In order to form the transfer tail, each end is led to a working area of a knotter through catching means composed of one or a pair of suction pipes. The knotter is operated to knot the respective ends together (Japanese Patent Public Disclosure (KOKAI) No. 1 317965). Both the ends are held at predetermined positions so as to be surely picked up by the catching means in the prior art. When picking up, the holding is to be canceled or released by picking up. Accordingly, each weft package has a different separated position from the weft package of the end at a time when each end is drawn into the catching means. In particular, each weft package has a different position with respect to an axial direction of the separated position of the leading end. That is, the position of the leading end when separated from the weft package is indefinite, as it comes sometimes at a front end or sometimes at a rear end of the weft package. Due to the difference in the separated position, there are caused different paths of the end from each weft package to the catching means. Therefore, there are also different paths of the end in the working area of the knotter. This sometimes results in a defective knotting performed by the knotter.

In a transfer tail formation apparatus having the catching means and the knotter, an operating portion of each catching means is positioned apart from a movement locus of each weft package in the weft feeding means, i.e., a rotation locus. Further, the operating portion is moved toward each end by moving the respective catching means to pick up each end.

On the other hand, each catching means which has picked up each end is operated to move each end toward the knotter so as to locate each end in the working area of the knotter. However, if the moving interval of the catching means can be reduced, it is considered possible to simplify a mechanism for moving the catching means as well as a movement control of the catching means.

SUMMARY OF THE INVENTION

It is an object of the present invention to provide a method of forming a transfer tail, wherein each weft package has substantially the same extending path of a weft end in a working area of a knotter. It is another object of the present invention to provide a transfer tail formation apparatus which can minimize a moving interval of catching means for picking up an end of the weft extending from a package supported by weft feeding means.

According to the present invention, a method of forming a transfer tail comprises the steps of moving a leading end and a tail end, which extend from a pair of weft packages supported by weft feeding means through a supporting member, to a working area of a knotter, and knotting both the ends together by the knotter while intermediate portions of the leading end and the tail end are respectively held by the support member or a surface of the weft package.

According to the present invention, an intermediate portion of the end held by each supporting member or the surface of the weft package can serve as substantial separation point of the end from each weft package. Further, it is possible to move both the ends to the working area of the knotter. Therefore, each weft package can have substantially the same extending path of the end in the working area of the knotter when forming the transfer tail. As a result, it is possible to avoid a defective knotting of the knotter, which is caused when weft packages have different paths.

The transfer tail formation apparatus of the present invention comprises catching means for picking up a tail end of the weft from one package and a leading end of the weft from the other package, and a knotter for splicing both the ends picked up by the catching means. The catching means is arranged such that an operating portion of the catching means is positioned on or in the vicinity of a movement locus of the ends of the weft from the packages at a time when both the weft packages are moved. According to the present invention, since the catching means is arranged such that the operating portion of the catching means is positioned on or in the vicinity of the movement locus of the weft end from the package at a time when both the weft packages are moved, the catching of each end can be performed after the weft end comes close to the operating portion of the catching means. Therefore, it is unnecessary to move the catching means toward the end to pick up the end. As a result, it is possible to dispense with a movement control and a movement mechanism or the like of the catching means for picking up the weft end.

The catching means can be disposed such that the operating portion of the catching means is positioned on or in the vicinity of the movement locus of the weft end from the package at a time when both the weft packages are moved. Further, the catching means can be disposed such that the operating portion of the catching means is positioned on or in the vicinity of the movement locus of the weft end from each package at a time when the weft package is fed to the weft feeding means. Thereby, it is also possible to dispense with moving of the catching means toward each end to pick up the weft end, or it is possible to minimize the moving interval.

The catching means may be movable together with both the weft packages and may be disposed such that the operating portion of the catching means is positioned on or in the vicinity of the movement locus of the weft end from each package at a time when the weft package is fed to the weft feeding means.

When the transfer tail is formed between a pair of weft packages supported by the weft feeding means, suction force of the catching means is preferably controlled as described below.

That is, the suction force of the catching means for drawing each weft end and maintaining the drawing condition of the weft end until the knotting is completed by the knotter, is defined as follows:

(suction force at a time of drawing the weft end) ≧
(suction force at a time of knotting the weft) >
(suction force after a time of drawing the weft end and before a time of knotting the weft)

According to this expression, it is ensured to draw the end into the catching means by setting the suction force at a time when drawing the weft end from each package to a large value. It is also possible to minimize any occurrence of untwisting of the weft end and damage accompanied with the untwisting weft end within the catching means by setting the suction force while the drawing condition of the weft end is maintained to a small value. Further, the weft can be stretched in an appropriate tensile force which is neither too strong nor too weak when knotting the weft. As a result, it is possible to realize a certain operation for knotting the weft, i.e., a certain formation of the transfer tail.

BRIEF DESCRIPTION OF THE DRAWINGS

The foregoing end other objects and features of the invention will become apparent from the following description of preferred embodiments of the invention with reference to the accompanying drawings, in which.

DETAILED DESCRIPTION OF THE PREFERRED EMBODIMENTS

Figure 1:
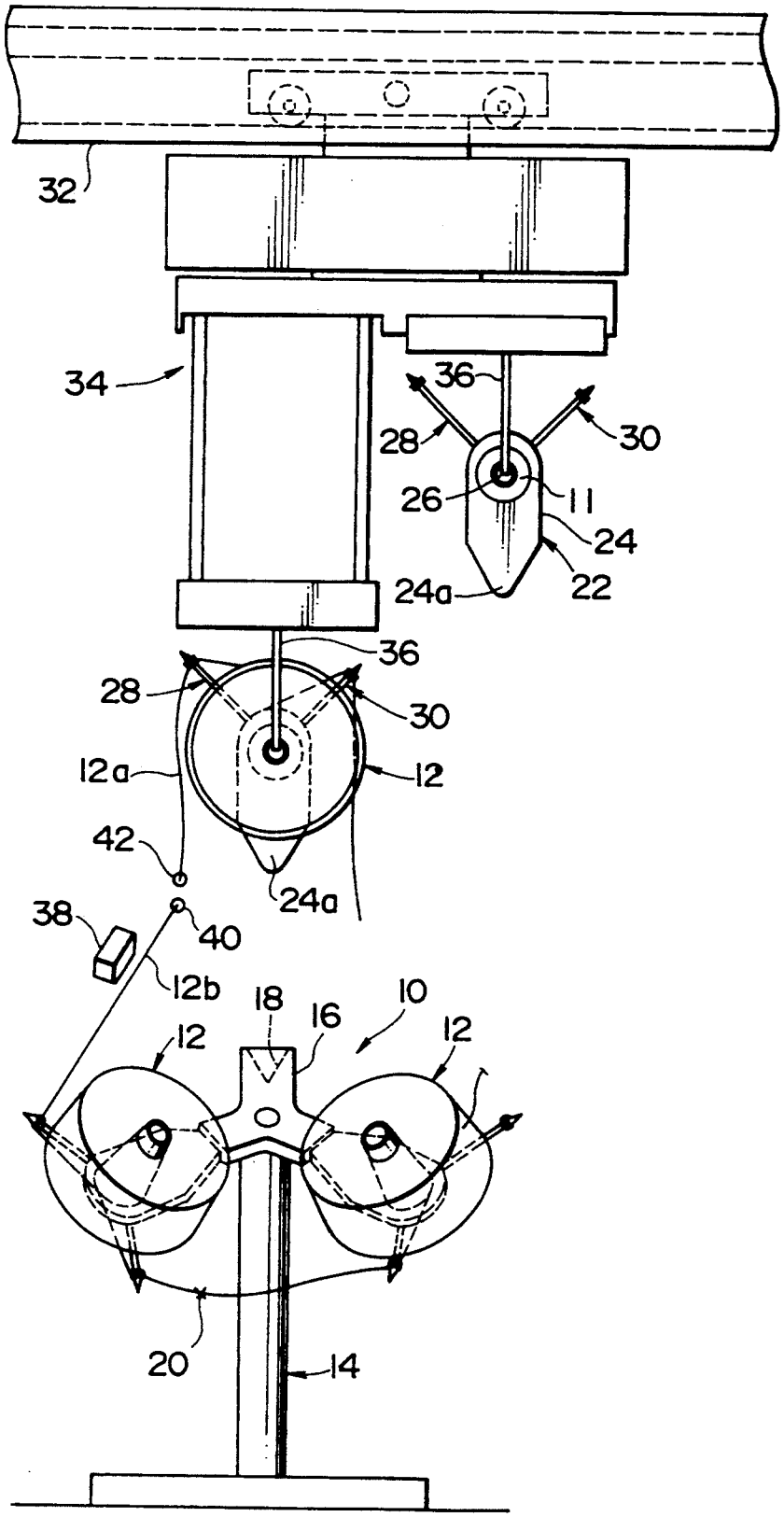
FIG. 1 is a schematic front view showing a knotter and catching means of a transfer tail formation apparatus according to the present invention together with weft feeding means and a carrying device for weft package.
Figure 2:
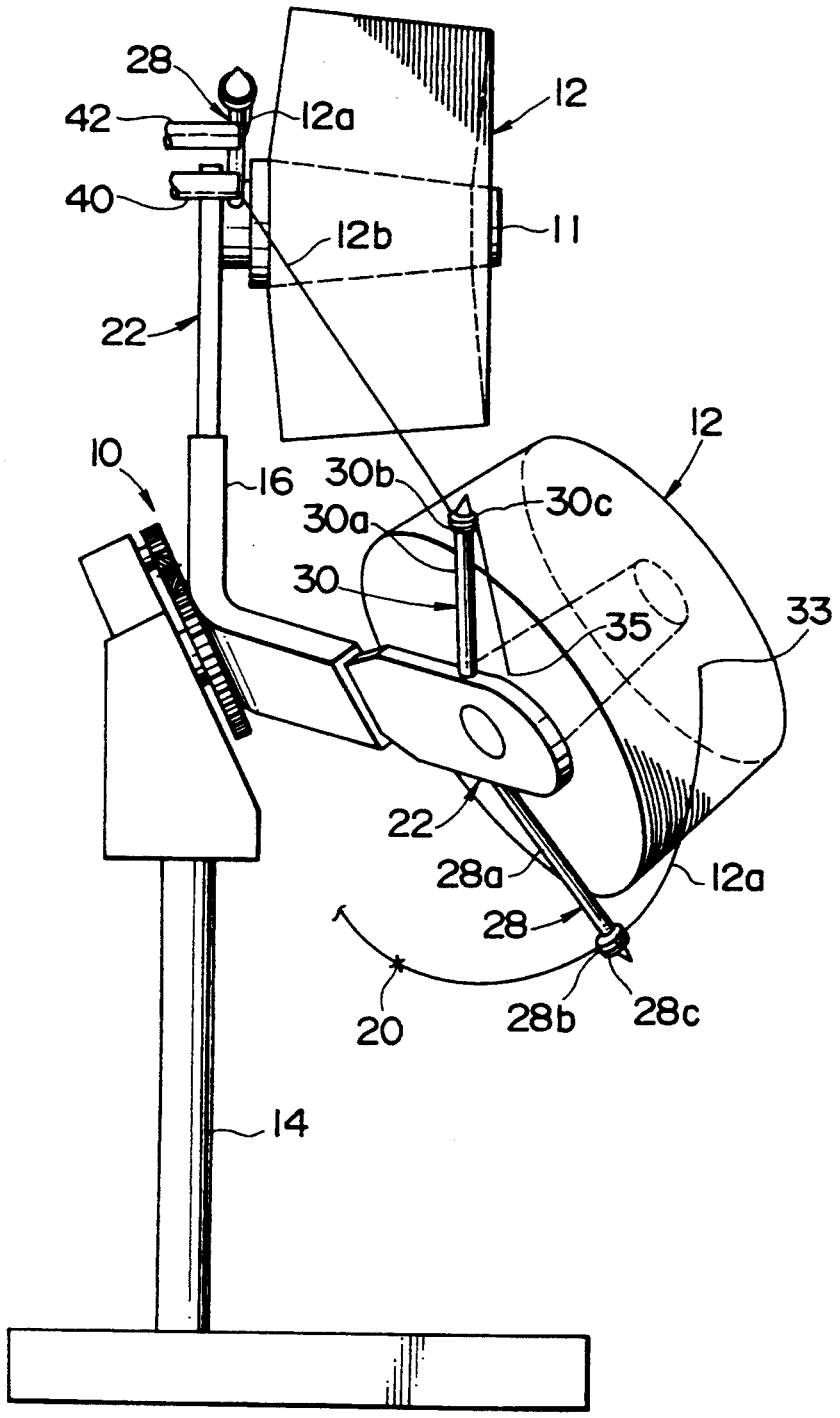
FIG. 2 is a schematic side view showing the catching means together with the weft feeding means.

Referring to FIGS. 1 and 2, weft feeding means 10 is mounted in the vicinity of a weaving machine (not shown) installed at a textile factory so as to feed weft to the weaving machine. The weft feeding means 10 depicted comprises a weft stand, and can support three weft packages 12 including the weft wound around a bobbin 11.

The weft feeding means 10 has a post 14 and a rotary member 16 which is supported by the post 14 and is rotatable about one axis extending in a diagonal direction, in particular, counterclockwise in the illustrated embodiment. The rotary means 16 includes three concave portions 18 which are arranged at each rotation angle of 120 degrees about the one axis. A bobbin holder 22 serves as a supporting member for supporting each weft package 12 on the rotary member 16 as described below, and is partially inserted into the respective concave portions 18.

These three weft packages 12 are respectively supported at a feeding position above the post 14, at a waiting position apart from the feeding position about the one axis counterclockwise by 120 degrees, and at a released position apart from the feeding position about the one axis clockwise by 120 degrees. A new weft package is provided from carrying means 34 as described below at the feeding position, and the bobbin 11 remaining after consumption of the weft is recovered at the feeding position. The weft is fed from the weft package 12 to the weaving machine at the released position, and a spare weft package 12 is waiting at the waiting position. In order to feed the weft successively, and the weft ends from a pair of mutually adjacent packages 12 are knotted together to form a transfer tail 20.

Each weft package 12 is supported through the bobbin holder 22 by the weft feeding means 10. The bobbin holder 22 includes a plate portion 24, a fitting portion 26 and a pair of holding portions 28 and 30. The fitting portion 26 extends from the plate portion 24 perpendicular to the plate portion, and has a truncated conical surface which is inserted into the bobbin 11. The pair of holding portions 28 and 30 can releasably hold the weft ends.

The plate portion 24 of the bobbin holder 22 has a pointed end **24*a* which is fitted into and releasably secured to the concave portion 18 of the rotary member 16 of the weft feeding means 10**.

Figure 4:
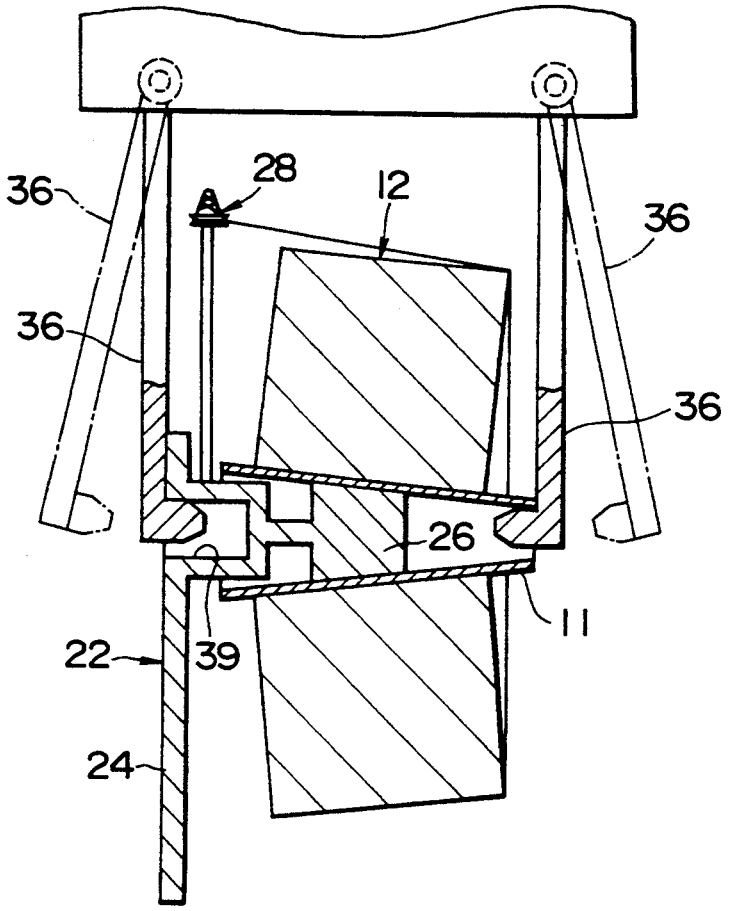
FIG. 4 is a longitudinal sectional view of supporting members and the weft package supported by the carrying device.

The respective holding portions 28 and 30 of the bobbin holder 22 have supporting rods **28*a* and 30*a* which are disposed at positions opposite to the pointed end 24*a* of the plate portion, and extend from side portions of the plate portion 24 (see FIG. 2) or the fitting portion 26 (see FIG. 4). These holding portions 28 and 30 further include a pair of disks 28*b*, 28*c*, 30*b* and 30*c* which are oppositely mounted at ends of the supporting rods 28*a* and 30*a***.

One disks **28*b* and 30*b* at the side of the plate portion 24 are respectively secured to the supporting rods 28*a* and 30*a*. The other disks 28*c* and 30*c* are respectively supported to be movable in each axial direction of the supporting rods 28*a* and 30*a***.

Figure 5:
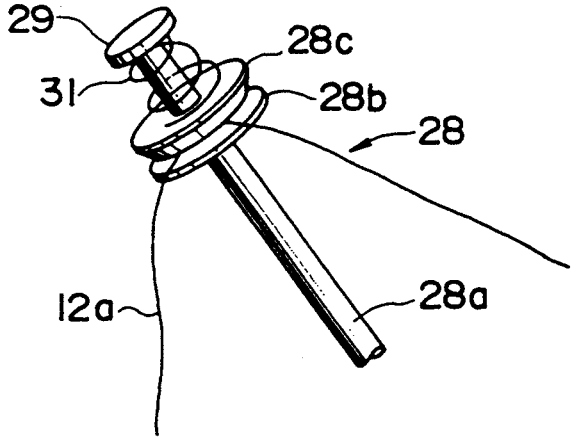
FIG. 5 is a partially enlarged perspective view of a holding portion of a weft end.

As typical by shown in FIG. 5, a spring bearing 29 is secured to the end of each supporting rod, and a coil spring 31 in a compressed state is arranged between the movable disk 28*c* and the spring bearing 29. The weft end from the package 12 is passed and held between both disks 28*b* and 28*c*. When the weft package disposed at the released position is switched over to the weft package disposed at the waiting position as a feeding package of the weft, spring force of the coil spring 31 is appropriately set so as to release the formed transfer tail from a holding condition of both disks 28*b* and 28*c*, and so as to derive the transfer tail from both disks when the end, i.e., the formed transfer tail is pulled toward the weaving machine through a yarn guide 44 which will be later described. Therefore, in order to form the transfer tail, the intermediate portions of both ends i.e., a leading end 12*a* and a tail end 12*b* are respectively held by the holding portions 28 and 30 while the leading end 12*a* and the tail end 12*b* are moved to the working area of a knotter 38 as described below which is an apparatus used for knotting the leading end and the tail end together, and while the knotter 38 is operated to knot the leading end 12*a* and the tail end 12*b* together. That is, the leading end 12*a* and the tail end 12*b* are respectively held between both disks 28*b* and 28*c* and between 30*b* and 30*c* in the illustrated embodiment. Accordingly, it is possible to position the weft end from each package at a position where the end is held by the holding portion 28, even if separation points 33, 35 (see FIG. 2) of the leading end 12*a* and the tail end 12*b* separated from the weft package 12 are arranged at any position with respect to the weft package. As a result, each weft package can have substantially the same extending path of the weft end in the working area of the knotter 38. Further, it is possible to avoid a defective knotting of the knotter 38 caused in case paths are different.

The working area of the knotter 38 refers to a working area of the knotter 38 in a firmly mounted position in case the knotter 38 is firmly mounted as shown in the figures. Alternatively, the working area of the knotter 38 refers to a working area in an advanced position in case the knotter advances from the waiting position when the knotter is operated.

The leading end 12*a* and the tail end 12*b* are moved to the working area of the knotter 38 by, for example, a suction pipe as described below. The weft end is first sucked and drawn in the suction pipe, and the suction pipe is then moved to a predetermined position while sending out a part of the weft end. Instead of the suction pipe, a movable grasping member may be employed. The grasping member flexibly grasps the weft end in the vicinity of the holding portions 28 and 30. Further, the grasping member is moved to the predetermined position while appropriate tensile force is applied to the weft end and a part of the weft end is escaped from each grasping member. Otherwise, the grasping member grasps a free end of the weft end and is moved to the predetermined position while grasping the free end.

Figure 6:
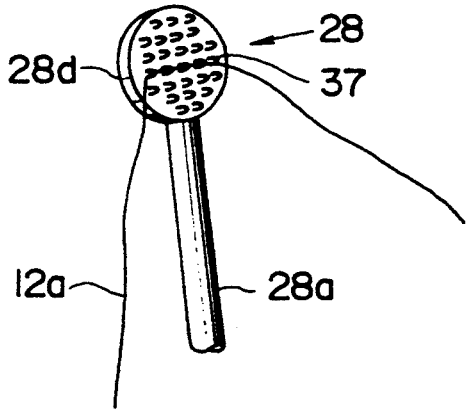
FIG. 6 is a partially enlarged perspective view of another embodiment of the holding portion of the weft end.

As typically shown in FIG. 6, in another embodiment of each holding portion, one holding portion 28 may comprise a supporting rod 28*a* and a tape piece 28*d* which is mounted on the end of the supporting rod 28*a*, and is crowded with many hooks 37 made of flexible plastic material.

The intermediate portion of the weft end can be hung on the hook 37 to hold the weft end by the holding portion 28. In addition, when drawing out the transfer tail formed by the weft end, the hook 37 is elastically deformed to release the weft end.

Figure 7:
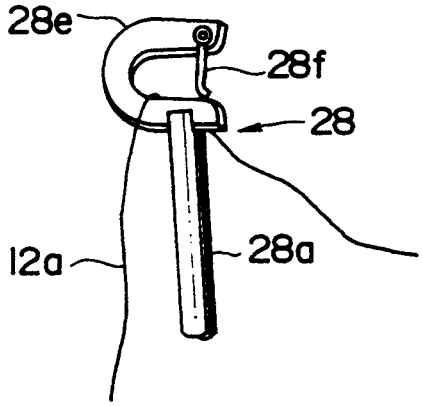
FIG. 7 is a partially enlarged perspective view of a further embodiment of the holding portion of the weft end.

As shown in FIG. 7, the holding portion 28 may also comprise the supporting rod 28*a*, a plate-like U-shaped member 28*e* mounted at the end of the supporting rod 28*a*, and a rod-like elastic member 28*f*, which is secured to the U-shaped member 28*e* and can be elastically deformed so as to releasably close an opening end of the U-shaped member. The weft end is passed through a space defined between the U-shaped member 28*e* and the elastic member 28*f*, and the intermediate portion of the weft end is held by these members. The U-shaped member 28*f* is provided such that the intermediate portion of the weft end is bent on the U-shaped member 28*e* when the end is moved by the suction pipe. Therefore, each weft package can have substantially the same path of the weft end. When the weft is released from the weft package by a weft inserting operation, tensile force acts on the weft end. At the time, the weft end passing through the space contacts the elastic member 28*f* to deform the elastic member 28*f* elastically, and leaves the space. The elastic member 28*f* may be omitted. In this case, the U-shaped member 28*e* is mounted on the supporting rod 28*a* with its opening end facing upwardly at the feeding position such that the intermediate portion of the weft end is bent on the U-shaped member 28*e* when the weft end is moved by the suction pipe, and such that the transfer tail leaves the opening end of the U-shaped member 28*e* because of own weight when the rotary member 16 of the weft feeding means 10 is rotated after the formation of the transfer tail.

The weft package 12 is mounted on the bobbin holder, and is suspended from a rail 32 mounted on the ceiling of the textile factory. Further, the weft package 12 is carried from a preparation room (not shown) in the textile factory to the weft feeding means 10 through carrying means 34, which is referred to as doffer and can travel along the rail 32.

Figure 3:
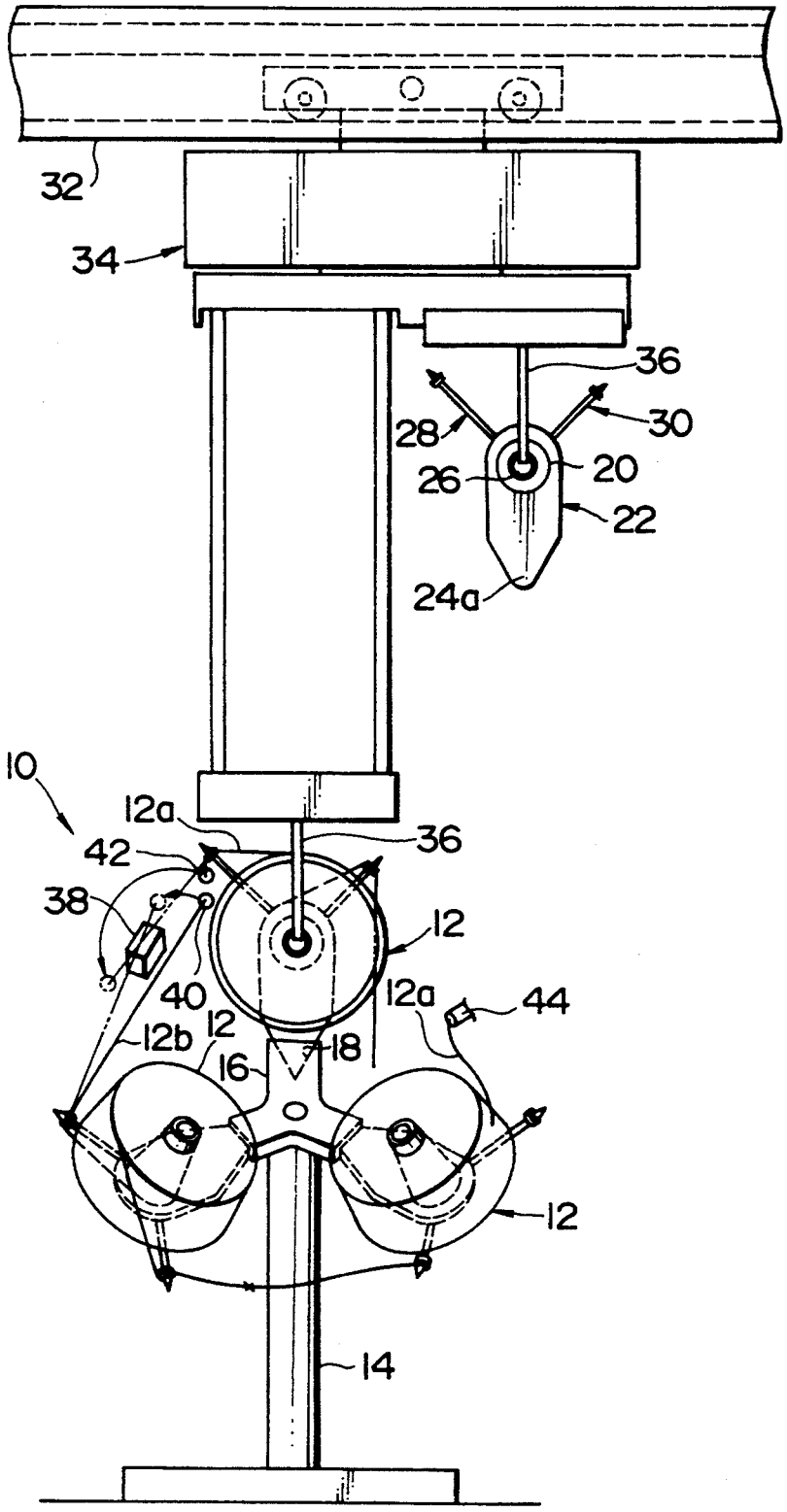
FIG. 3 is a schematic front view showing a state in which the weft package supported by the carrying device is further lowered toward the weft feeding means from the state as shown in FIG. 1.

As shown in FIGS. 1, 3 and 4, the carrying means 34 is provided with two pairs of arms 36 which can separately grasp and vertically move two of the weft packages 12. The respective pairs of arms 36 are rockable about horizontal axes in parallel with each other. The respective pairs of arms 36 are provided with hooked pointed ends (see FIG. 4). When these hooked pointed ends are respectively rocked toward mutually opposite arms, i.e., in the closing direction, these hooked pointed ends can engage a small diameter end of the bobbin 11 of the weft package 12 and a hole 39 provided in the plate portion 24 of the bobbin holder 22 coaxially with a large diameter end of the bobbin 11 to grasp the weft package 12. On the other hand, when the respective pairs of arms 36 are rocked in the opening direction, the grasped weft package 12 can be released.

The carrying means 34 is stopped such that one pair of arms 36 grasping the weft package 12 is disposed directly above the rotary member 16 of the weft feeding means 10.

When one pair of arms 36 are lowered in this condition (see FIG. 1), the pointed end portion 24*a* of the plate portion 24 of the bobbin holder 22 is inserted into one of the concave portions 18 of the rotary member 16 (see FIG. 3).

Thus, the weft package 12 grasped by one pair of arms 36 can be provided for the weft feeding means 10 at the feeding position.

Prior to feeding of the weft package 12, the other pair of empty arms 36 are lowered toward the bobbin 11 disposed at the feeding position to grasp and recover the bobbin 11 and the bobbin holder 22.

The knotter 38, a suction pipe 40 and a suction pipe 42 as the catching means in the illustrated embodiment are disposed in the vicinity of the weft feeding means 10. The knotter 38 serves for knotting a pair of ends extending from a pair of mutually adjacent weft packages 12 held by the weft feeding means 10, that is, the leading end 12*a* of weft from one package and the tail end 12*b* of weft from the other package together. The catching means picks up both weft ends, respectively, and can move the picked ends to the working area of the knotter 38, i.e., an area where the knotter 38 is operated to knot both weft ends together.

In another embodiment, the catching means may employ a combination of a movable weft grasping apparatus or an immovable static suction pipe and the yarn guide which can move the weft end picked up by the suction pipe to the working area of the knotter.

The knotter 38 and the suction pipes 40 and 42 are provided as a part of a transfer tail formation apparatus. The knotter 38 and the suction pipes 40 and 42 in the illustrated embodiment are mounted on the weaving machine. The suction pipe may be also mounted on the rotary portion of the weft feeding means 10 as described below.

In the embodiment shown in FIGS. 1 to 3, and FIGS. 8 to 18, the opening end serving as an operating portion of the one suction pipe 42 is positioned on or in the vicinity of a vertical movement locus which is described by the leading end 12*a* held between the holding portion 28 of the bobbin holder when the weft package 12 is provided for the weft feeding means 10 by the carrying means 34. Accordingly, the suction pipe 42 can finish sucking the leading end 12*a* of the weft in the weft package 12 suspended from the pointed end of the holding portion 28 of the bobbin holder to draw into the suction pipe 42 by the time when the weft package 12 is lowered to be held by the weft feeding means 10.

The opening end of the other suction pipe 40 is disposed on or in the vicinity of a rotation locus of the tail end 12*b* held by the holding portion 30 of the bobbin holder which is rotated and moved together with the weft package 12 counterclockwise from the feeding position to the waiting position. Therefore, the suction pipe 40 can suck the tail end 12*b* of the weft in the weft package suspended from the holding portion 30 to draw into the suction pipe 40 while the weft package 12 is rotated and moved.

When the weft package is held by the bobbin holder without the holding portions 28, 30, the opening ends of the suction pipes 40 and 42 are positioned on or in the vicinity of a movement locus of the weft end suspended from the weft package. In this case, preferably, the weft end is partially secured to a certain portion of the weft package in advance so that the weft end from each package can describe the same movement locus. For example, the end may be held by a surface of the weft package simply by using a fluff, or the weft end may be pasted on the surface of the weft package to hold in a successful operation range for the weft inserting.

Figure 8:
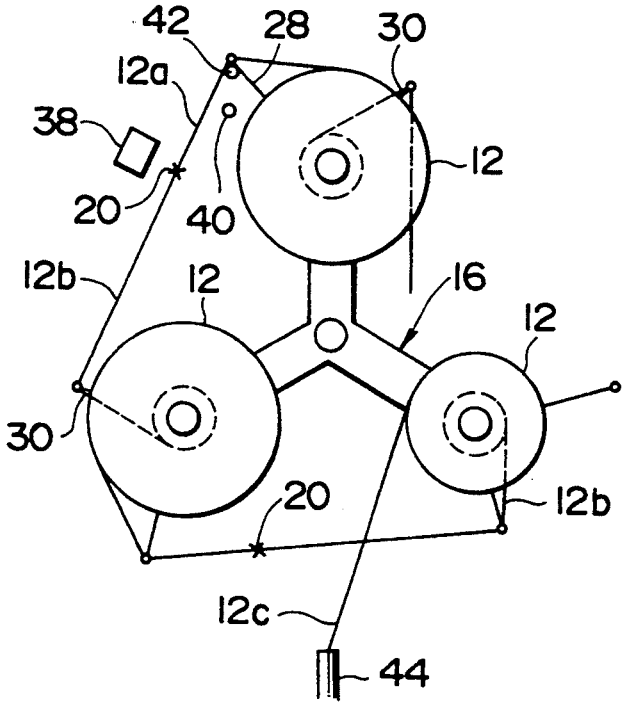
FIG. 8 is a schematic view showing a state in which three weft packages are held by the weft feeding means to feed weft from the weft package disposed at a released position to a weaving machine.

Referring now to FIG. 8, three weft packages 12 are held by the rotary member 16 of the weft feeding means. Further, the transfer tails 20 are respectively formed between the weft package 12 at the feeding position and that at the waiting position, and between the other weft package 12 at the waiting position and that at the released position. The weft 12*c* is fed from the weft package 12 at the released position to the weaving machine through a yarn guide 44.

Figure 9:
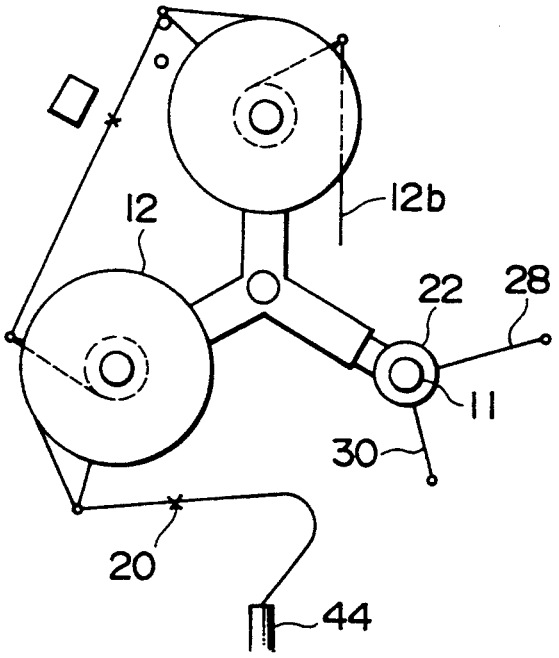
FIG. 9 is a schematic view showing a state in which the weft of the weft package disposed at the released position is consumed, and the weft package is being replaced with the weft package disposed at a waiting position as a feeding package of the weft.
Figure 10:
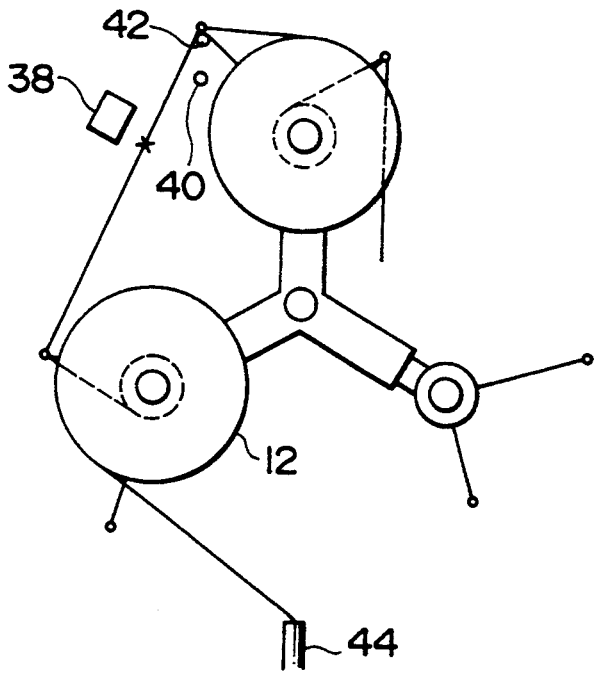
FIG. 10 is a schematic view showing a state in which the weft package disposed at the waiting position is serving as the feeding package of the weft.

As shown in FIGS. 9 and 10, when the weft of the weft package 12 disposed at the released position is consumed, the weft is fed successively from the spare weft package 12 at the waiting position through the transfer tail 20 formed between the released position and the waiting position.

Figure 11:
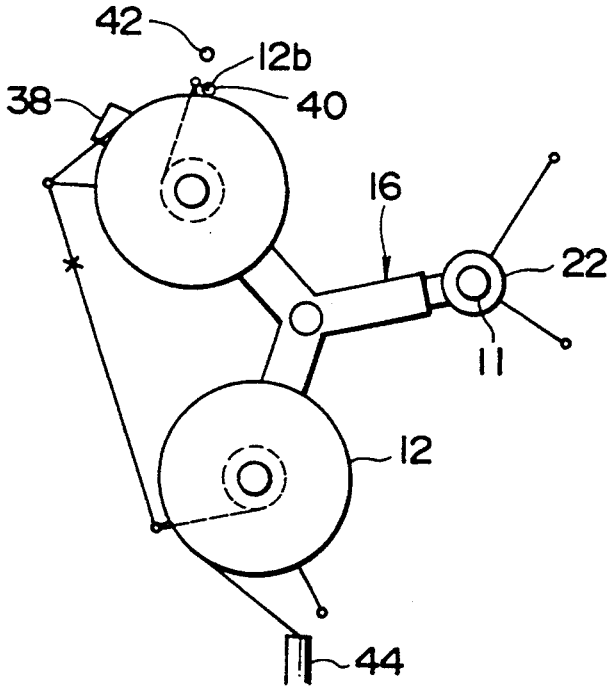
FIG. 11 is a schematic view showing a state in which a rotary portion of the weft feeding means is in the course of rotation, and a tail end of the weft from the package which has been disposed at a feeding position is drawn into a first suction pipe.
Figure 12:
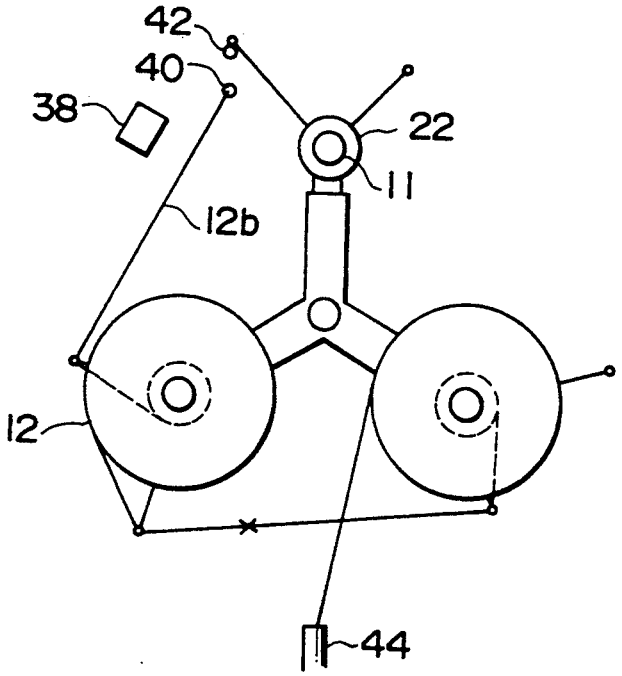
FIG. 12 is a schematic view showing a state immediately after the rotary portion is rotated by a rotation angle of 120 degrees.

As shown in FIGS. 11 and 12, the rotary member 16 is counterclockwise rotated by 120 degrees while feeding the weft from the weft package 12 at the waiting position. In addition, the bobbin holder 22 and the empty bobbin 11 (which is simplified for the sake of drawings) which are disposed at the released position are moved to the feeding position. The rotary member 16 is started to rotate, and simultaneously, the suction pipe 40 is started to suck. At the time, the suction pipe 42 is in the inoperative condition.

During the rotation, the tail end 12*b* of the weft package 12 disposed at the feeding position is sucked into the suction pipe 40 while the end is rotated as shown in FIG. 11.

Figure 13:
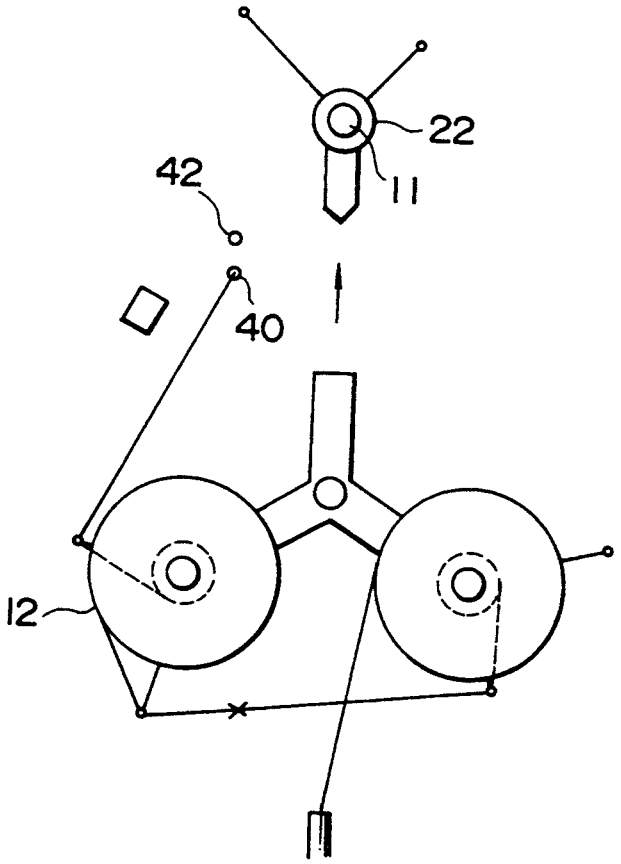
FIG. 13 is a schematic view showing a state in which a bobbin holder moved by the rotation of the rotary portion to the feeding position is upwardly transferred.
Figure 14:
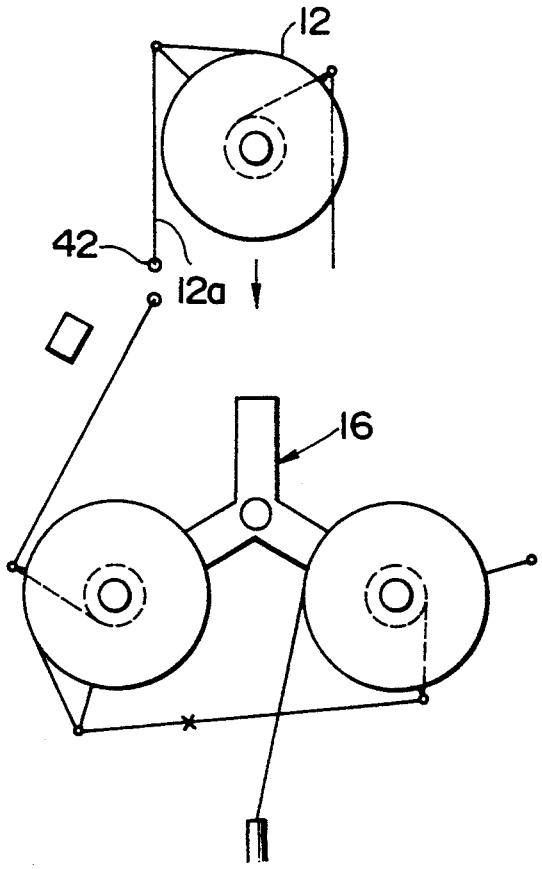
FIG. 14 is a schematic view showing a state in which a new weft package is lowered to be provided for the weft feeding means and a leading end of the weft package is drawn into a second suction pipe.
Figure 15:
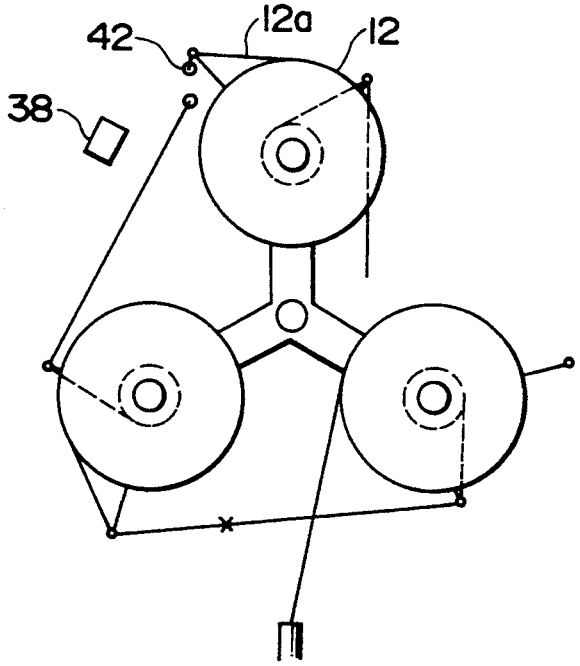
FIG. 15 is a schematic view showing a state in which the new weft package is held by the rotary portion.

Thereafter, the carrying means is operated to recover the bobbin holder 22 and the bobbin 11 as shown in FIG. 13, and a new weft package 12 is provided for the rotary member 16 as shown in FIGS. 14 and 15. When the carrying means is moved to a predetermined position above the weft feeding means or when the weft package 12 is started to lower by one pair of arms 36, the suction pipe 42 is started to suck. Consequently, the leading end 12*a* of the weft package 12 is drawn into the suction pipe 42 while the weft package 12 is lowered to be provided for the weft package 12.

Figure 16:
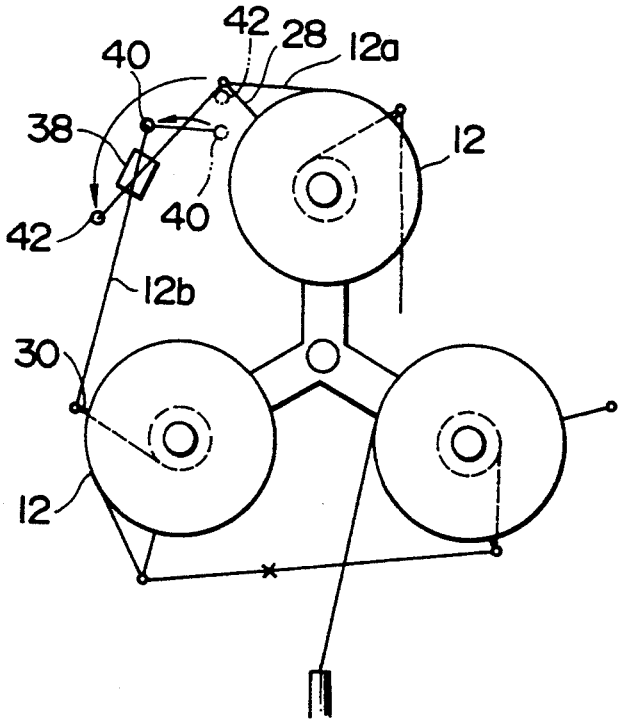
FIG. 16 is a schematic view showing a state in which both the weft ends are kept sucked by both the suction pipes, and both the suction pipes are moved so as to move both the weft ends to a working area of the knotter.

After feeding the weft package 12, as shown in FIG. 16, the suction pipes 40 and 42 are respectively moved so as to move the leading end 12*a* and the tail end 12*b* held by the suction pipes to the working area of the knotter 38 such that both the ends intersect. At the time, the leading end 12*a* and the tail end 12*b* are moved with the intermediate portions thereof held by the holding portions 28 and 30. Further, the leading end 12*a* and the tail end 12*b* are guided while being partially led from the suction pipes with the movement of the suction pipes 40 and 42.

Figure 17:
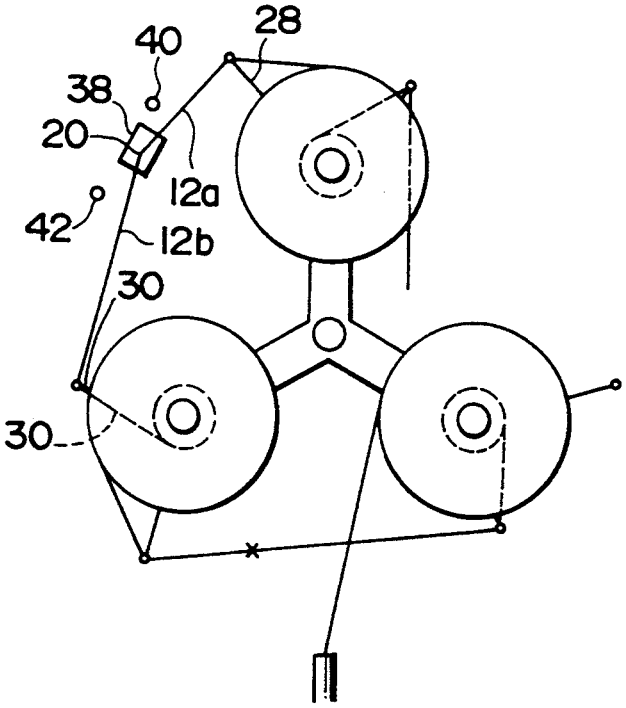
FIG. 17 is a schematic view showing a state in which the transfer tail is formed by the knotter.
Figure 18:
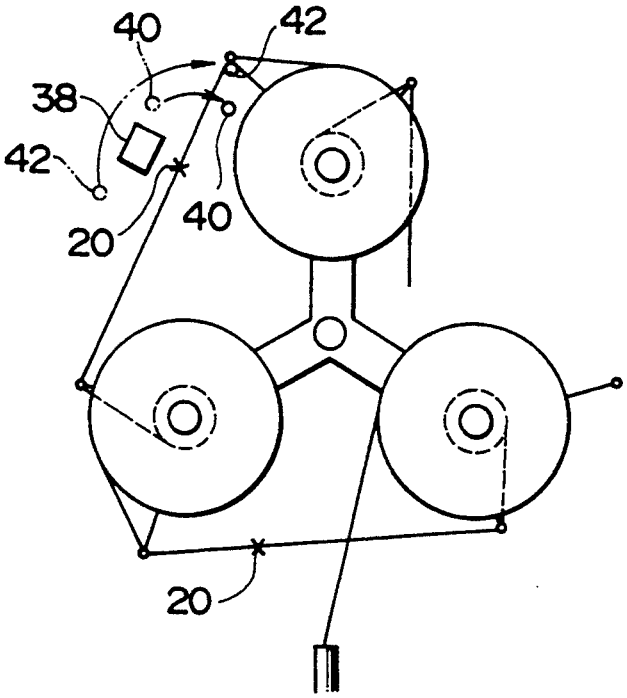
FIG. 18 is a schematic view showing a state in which both the suction pipes are returned to original positions as shown in FIG. 3.

Subsequently, as shown in FIG. 17, the knotter 38 is operated to splice the leading end 12*a* and the tail end 12*b* together to form the transfer tail 20. After forming the transfer tail 20, as shown in FIG. 18, both suction pipes 40 and 42 are returned to original positions, i.e., the same positions as shown in FIG. 8, and the suction operation is stopped.

The suction forces of the suction pipes 40 and 42 are preferably set as follows. That is, large values are set for the suction force of the suction pipe 42 to the leading end 12*a* and the suction force of the suction pipe 40 to the tail end 12*b*. With strong suction forces, it is ensured to draw the leading end 12*a* and the tail end 12*b* into the suction pipes 42 and 40, respectively.

A period for providing the suction pipe 40 with the strong suction force can be set to be, for example, a time when the rotary member 16 is started to rotate from the condition as shown in FIG. 10. Further, a period for providing the suction pipe 42 with the strong suction force can be set to be, for example, a time preceding the condition as shown in FIG. 14, i.e., a time when a new weft package is started to lower.

After a sensor (not shown) or the like mounted inside the suction pipe 40 detects that the end is drawn into the suction pipe 40, the suction force of the suction pipe 40 is reduced to a sufficient suction force of 0 or more values for holding the weft end, i.e., the tail end 12*b* in the suction pipe 40 after the lapse of a predetermined time required for drawing or after the completion of the rotary operation of the rotary member 16. Also, in the case of the suction pipe 40, after detecting by a sensor (not shown) or the like mounted inside the suction pipe 42 that the weft end is drawn into the suction pipe 42, the suction force of the suction pipe 42 is reduced to a sufficient suction force for holding the end, i.e., the leading end 12*a* in the suction pipe 42 after the lapse of a predetermined time required for drawing or after the weft package 12 is held by the rotary member 16 (see FIG. 15).

Thus, the ends in the suction pipes 40 and 42 are released from any influences caused by the strong suction force, i.e., a twist in the ends. Accordingly, damage to the end can be avoided.

During the operation of the knotter 38, appropriate tensile force should be provided for the respective leading end 12*a* and the tail end 12*b*. Therefore, the suction forces of the suction pipes 42 and 40 are set to values less than or equal to the value at a time when drawing the end, and more values than at a time when holding the end.

After forming the transfer tail 20 (see FIG. 17), the suction forces of the respective suction pipes 40, 42 are set to 0.

In the above embodiment, a pair of suction pipes 40 and 42 are provided to pick up the respective leading end 12*a* and the tail end 12*b* of the weft package. However, either one of the suction pipes may be omitted to employ a single suction pipe. For example, the suction pipe 42 may be omitted since the opening end of the suction pipe 40 is disposed not only in the vicinity of the rotation locus of the tail end 12*b*, but also in the vicinity of the movement locus of the leading end 12*a*.

A single suction pipe may be provided to pick up the leading end 12*a* and the tail end 12*b* movably between a predetermined position in the vicinity of the movement locus of the leading end 12*a* and a predetermined position in the vicinity of the rotation locus of the tail end 12*b*. In the embodiment, the tail end 12*b* can be picked up at the predetermined position in the vicinity of the rotation locus of the tail end 12*b* while the rotary member is operated to rotate. Subsequently, the suction pipe can be moved to the predetermined position in the vicinity of the movement locus of the leading end 12*a* to pick up the leading end 12*a* while providing the weft package 12. In a modification of the embodiment, the suction pipe has an amount of movement more than that of the suction pipe in another embodiment since the suction pipe is moved between two positions. The amount of movement, however, is less than that of the conventional suction pipe for picking up the end. Further, since the predetermined position can be set on or in the vicinity of the movement locus of the weft end, it is possible to set a large selective range for the position and to further reduce the amount of movement.

Referring now to FIGS. 19 to 29, one embodiment is illustrated which employs a single suction pipe 46 serving as the catching means for picking up the weft end (tail end) 12*b* from a package 12A disposed at the waiting position and the end (leading end) 12*a* of a weft package 12B disposed at the feeding position.

The suction pipe 46 is mounted on the weaving machine and arranged such that an opening end of the suction pipe 46 is positioned on or in the vicinity of the rotation locus of the weft ends 12*a*, 12*b* from both packages when the weft packages are rotated about the one axis.

Figure 19:
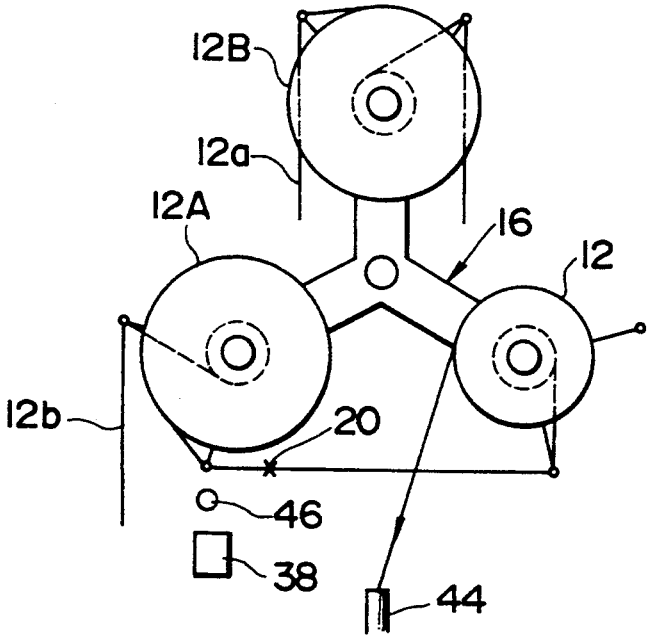
FIG. 19 is a schematic view showing a state in which three weft packages are held by weft feeding means to feed weft from the weft package disposed at a released position in another embodiment.
Figure 20:
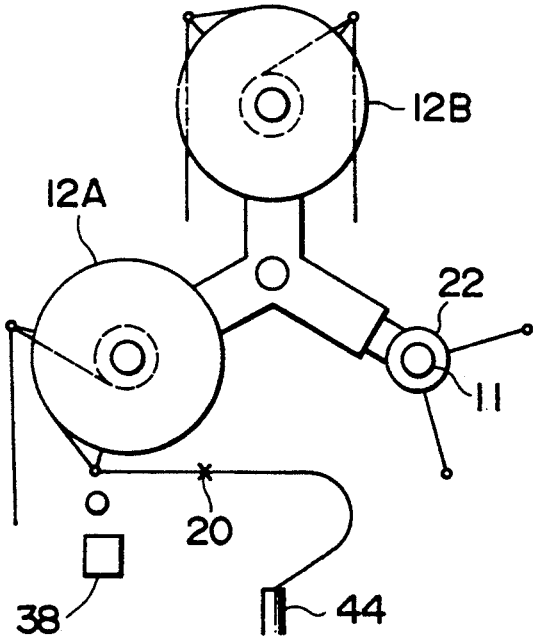
FIG. 20 is a schematic view showing a state in which the weft of the weft package disposed at the released position is consumed, and the weft package is being replaced with the weft package disposed at a waiting position as the feeding package of the weft.
Figure 21:
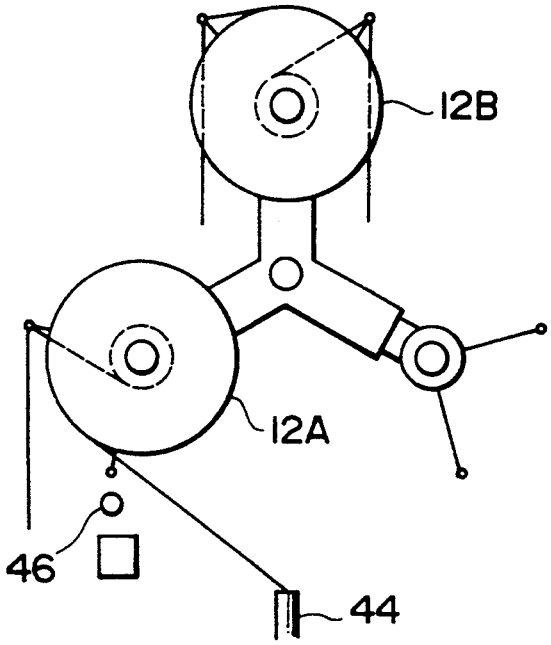
FIG. 21 is a schematic view showing a state in which the weft package disposed at the waiting position is serving as the feeding package of the weft.
Figure 22:
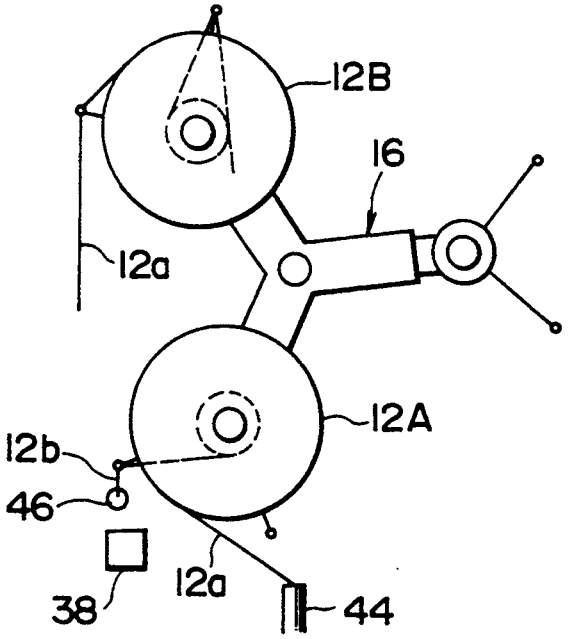
FIG. 22 is a schematic view showing a state in which a rotary portion of the weft feeding means is in the course of rotation, and a tail end of the weft from the package which has been disposed at the waiting position is drawn into a suction pipe.
Figure 23:
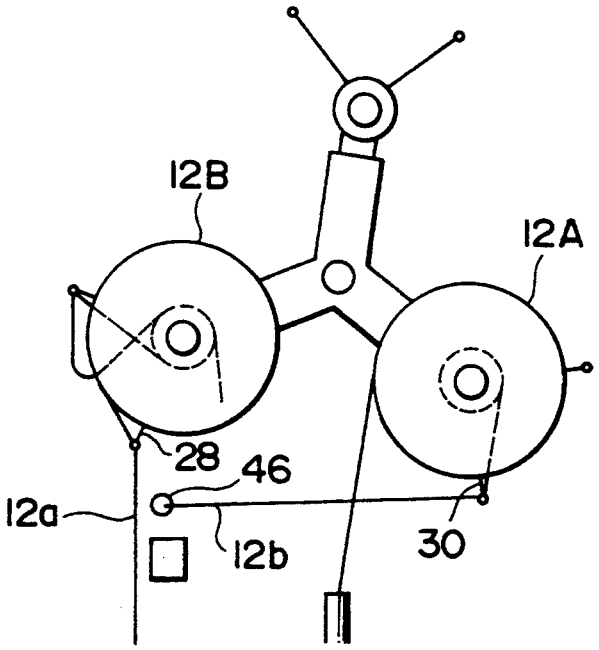
FIG. 23 is a schematic view showing a state immediately before the rotary portion is rotated by a rotation angle of 120 degrees.
Figure 24:
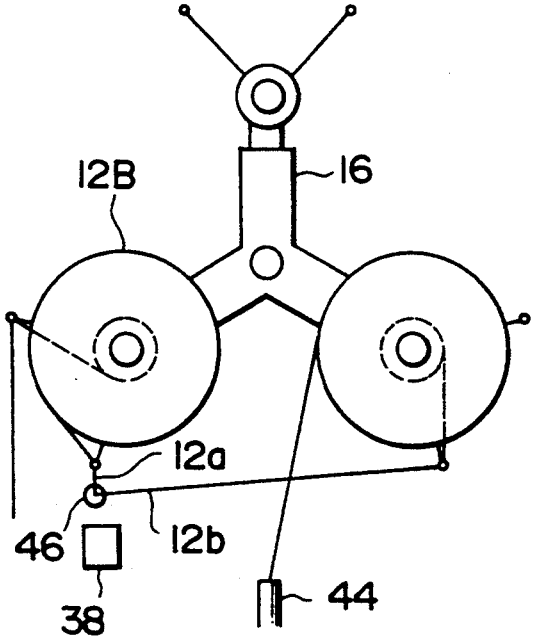
FIG. 24 is a schematic view showing a state in which the rotary portion is rotated by the rotation angle of 120 degrees, and a leading end of the weft from the package which has been disposed at a feeding position is drawn into the suction pipe.
Figure 25:
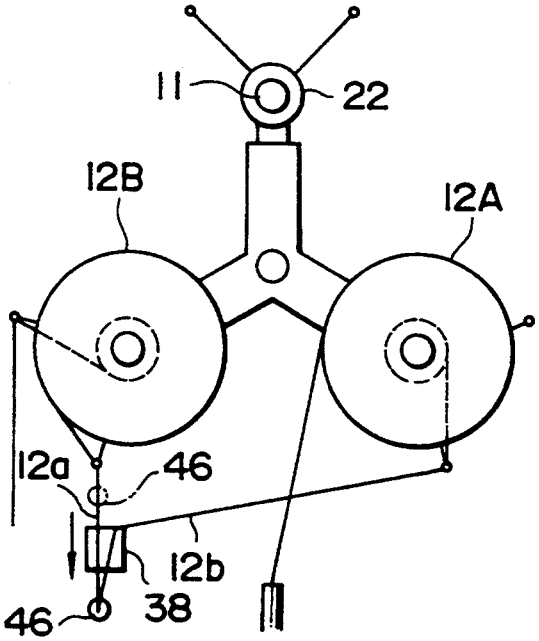
FIG. 25 is a schematic view showing a state in which both the weft ends are kept sucked into the suction pipe, and the suction pipe is moved so as to move both the weft ends to a working area of a knotter.
Figure 26:
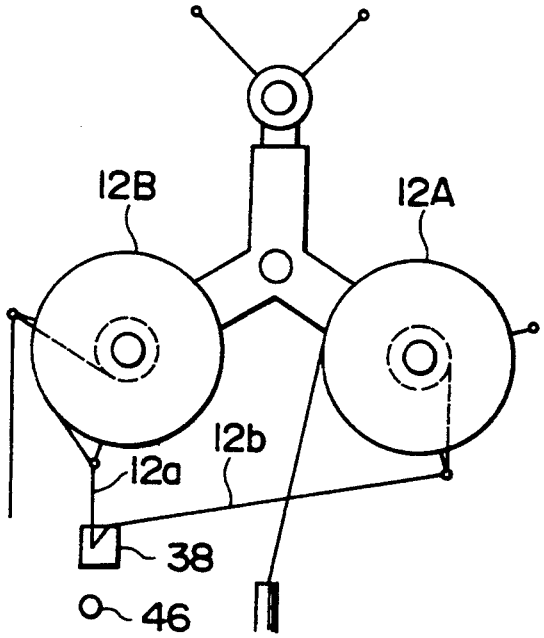
FIG. 26 is a schematic view showing a state in which the transfer tail is formed by the knotter.
Figure 27:
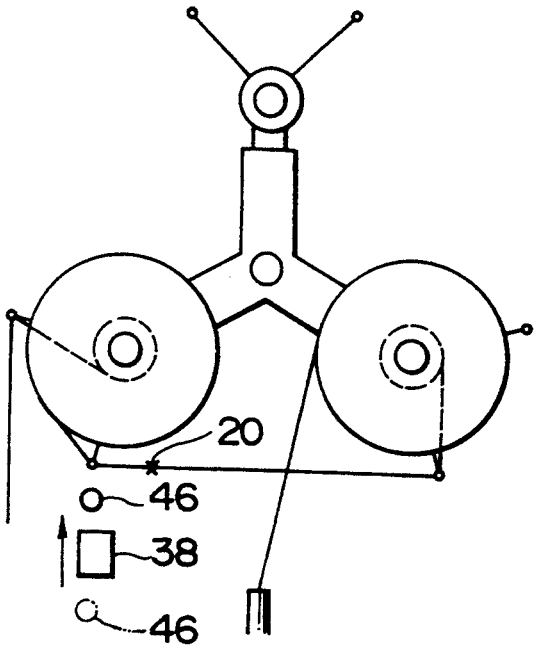
FIG. 27 is a schematic view showing a state in which the suction pipe is returned to the original position as shown in FIG. 19.
Figure 28:
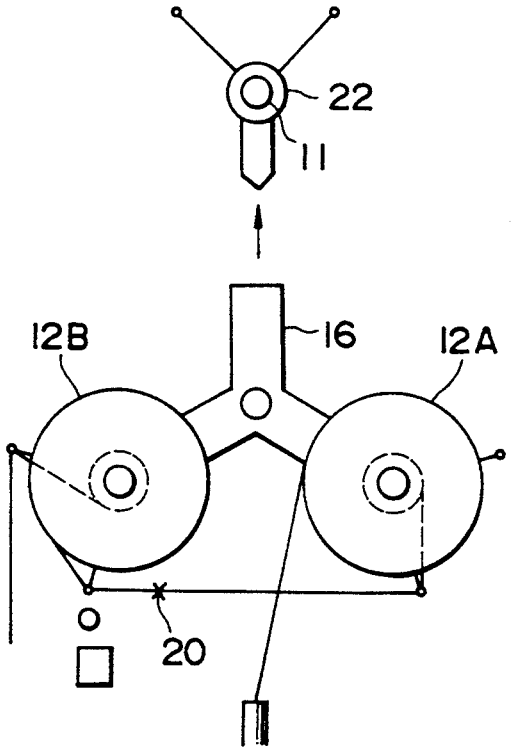
FIG. 28 is a schematic view showing a state in which a bobbin holder moved by the rotation of the rotary portion to the feeding position is upwardly transferred.

As shown in FIGS. 19 to 21, when the weft of the weft package 12 at the released position is consumed, the weft is fed from the spare weft package 12A disposed at the waiting position on the left-hand side of the released position through the transfer tail 20. As shown in FIGS. 22 to 24, the rotary member 16 is rotated counterclockwise by 120 degrees while feeding the weft from the weft package 12A at the waiting position. Further, the bobbin holder 22 and the bobbin 11 disposed at the released position are moved to the feeding position. When the rotary member 16 is started to rotate, the suction pipe 46 is started to suck.

During the operation, as shown in FIG. 22, the tail end 12*b* of the weft from the package 12A disposed at the waiting position is sucked in, i.e., picked by the suction pipe 46 during the rotation. Continuously, as shown in FIG. 24, the leading end 12*a* of the weft from the package 12B disposed at the feeding position is sucked in the same suction pipe 46 during the rotation.

Subsequently, the suction pipe 46 holding both weft ends 12*a* and 12*b* is moved to the working area of the knotter 38. Accordingly, the respective weft ends 12*a* and 12*b* can be paralleled in the working area of the knotter 38 (see FIG. 25). The knotter 38 is operated to splice both weft ends 12*a* and 12*b* (see FIG. 26). After forming the transfer tail 20, the suction pipe 46 is returned to an original position, i.e., the same position as shown in FIG. 19 to stop the suction operation.

Figure 29:
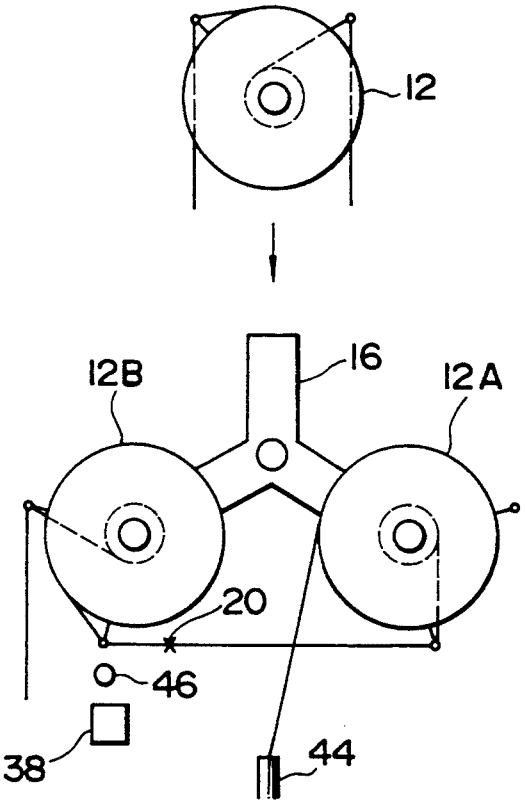
FIG. 29 is a schematic view showing a state in which a new weft package is lowered to be provided for the weft feeding means.

Thereafter, the carrying means is operated to recover the bobbin holder 22 and the bobbin 11 (see FIG. 28), and a new weft package 12 is provided for the rotary member 16 (see FIG. 29).

In the above embodiment, the intermediate portions of the weft ends 12*a* and 12*b* of the weft package are respectively held by the holding portions 28 and 30. The single suction pipe is employed since each rotation locus is identical. However, the suction pipe should be provided for the respective ends 12*a* and 12*b* when each rotation locus is different from the other. Alternatively, the single suction pipe may be provided movably between the position in the vicinity of the rotation locus of the end 12*a* and the position in the vicinity of the rotation locus of the end 12*b*. Further, the single suction pipe may be moved between the two positions to pick up the ends 12*a* and 12*b* while the rotary member 16 is rotated counterclockwise by 120 degrees.

Referring now to FIGS. 30 to 40, a further embodiment is illustrated which employs three suction pipes 48 rotatable about the one axis together with the weft packages held by the rotary member 16. Three suction pipes 48 are respectively arranged between the mutually adjacent positions, i.e., between the feeding and waiting positions, between the waiting and released positions, and between the released and feeding positions. A yarn guide 50 mounted on the weaving machine can be moved toward the working area of the knotter 38.

Figure 37:
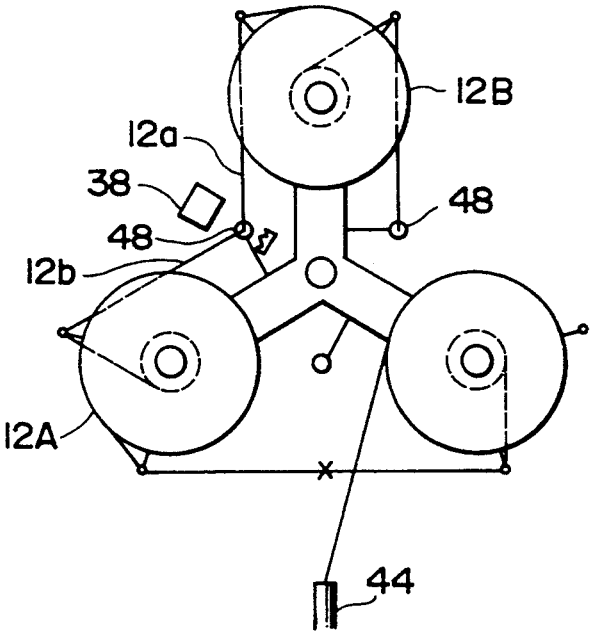
FIG. 37 is a schematic view showing a state in which a leading end of weft from the provided package is drawn into a suction pipe.

Among the three suction pipes 48, two suction pipes disposed at the upper positions should pick up the weft end (tail end) 12*b* and the other weft end (leading end) 12*a* of the weft from the package 12B which is provided for the rotary member 16, respectively (see FIG. 37). Therefore, the suction pipes 48 are arranged such that opening ends of the suction pipes 48 are positioned on or in the vicinity of the movement loci of the weft ends 12a and 12b from the package 12B when the weft package is provided for the rotary member 16 by the carrying means.

Figure 30:
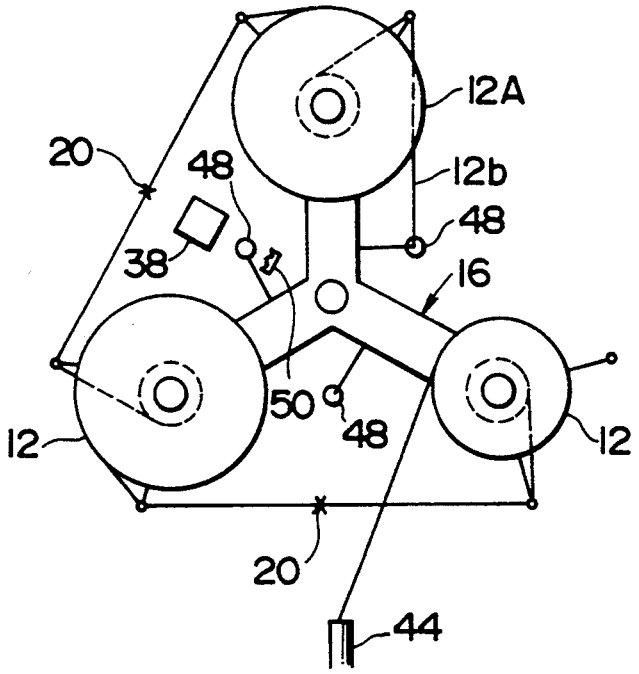
FIG. 30 is a schematic view showing a state in which three weft packages are held by weft feeding means to feed weft from the weft package disposed at a released position in a further embodiment.
Figure 31:
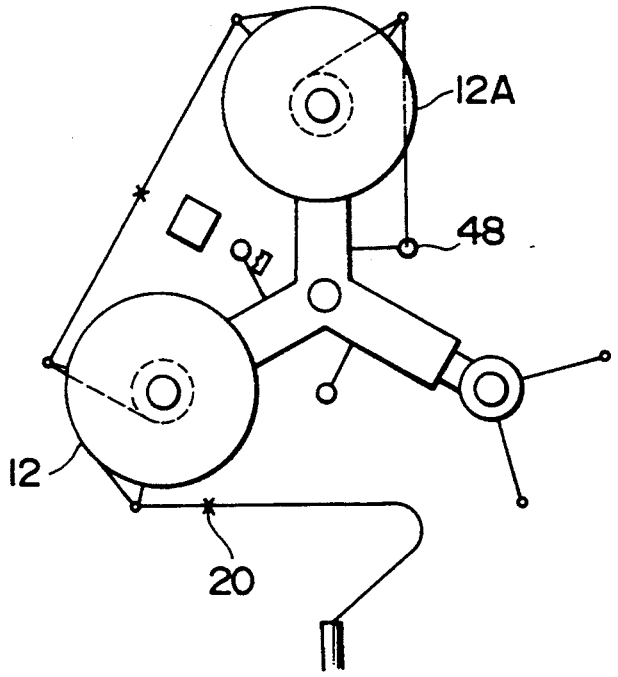
FIG. 31 is a schematic view showing a state in which the weft of the weft package disposed at the released position is consumed, and the weft package is being replaced with the package disposed at a waiting position as a feeding package of the weft.
Figure 32:
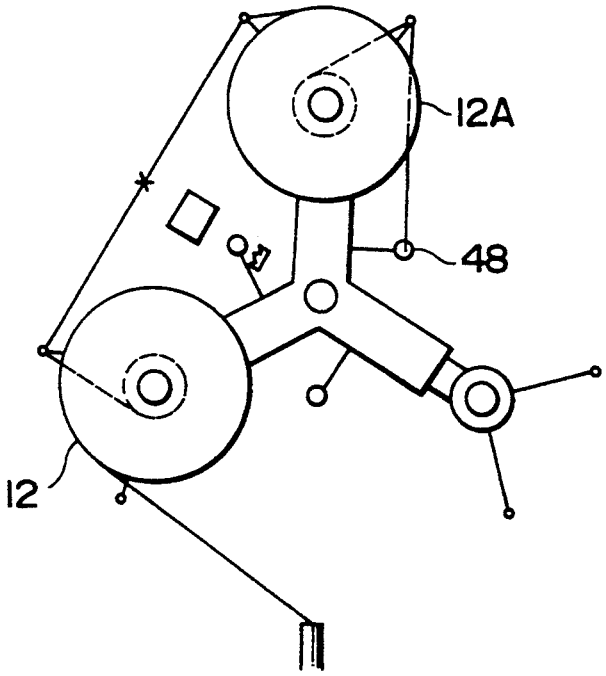
FIG. 32 is a schematic view showing a state in which the weft package disposed at the waiting position is serving as the feeding package of the weft.

As shown in FIGS. 30 to 32, when the weft of the weft package 12 disposed at the released position is consumed, the weft can be fed from the spare weft package 12 which is disposed at the waiting position on the left-hand side of the released position through the transfer tail 20. Prior to feeding of the weft from the spare weft package 12, the weft package 12A is provided for the rotary member 16. When the weft package 12A is lowered and provided, the tail end 12b of the weft from the package 12A has been completely sucked in the suction pipe 48 between the feeding position and the released position. In addition, the leading end of the weft from the package 12A has the transfer tail which is formed by the weft package 12 disposed at the waiting position by a method as described below.

Figure 33:
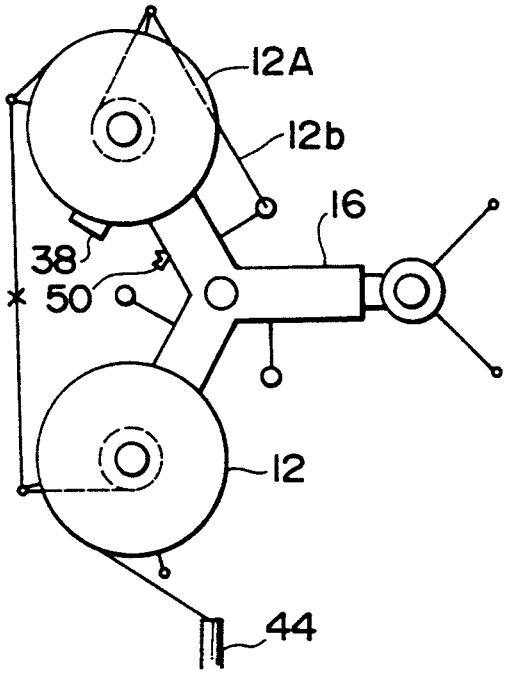
FIG. 33 is a schematic view showing a state in which a rotary portion of the weft feeding means is in the course of rotation.
Figure 34:
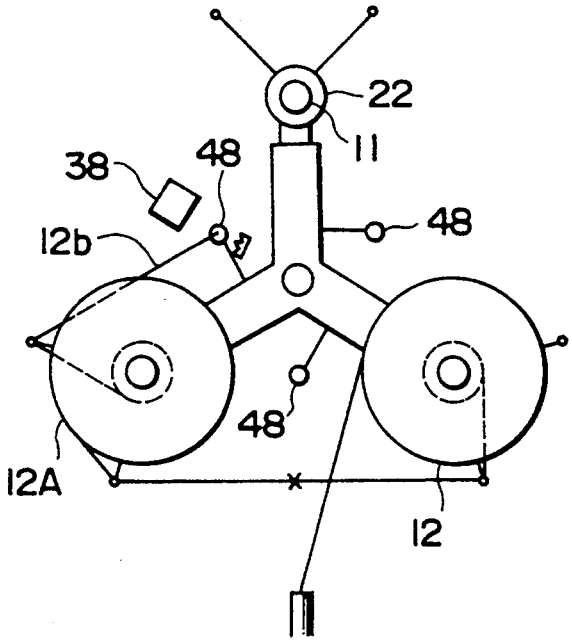
FIG. 34 is a schematic view showing a state immediately after the rotary portion is rotated by a rotation angle of 120 degrees.
Figure 35:
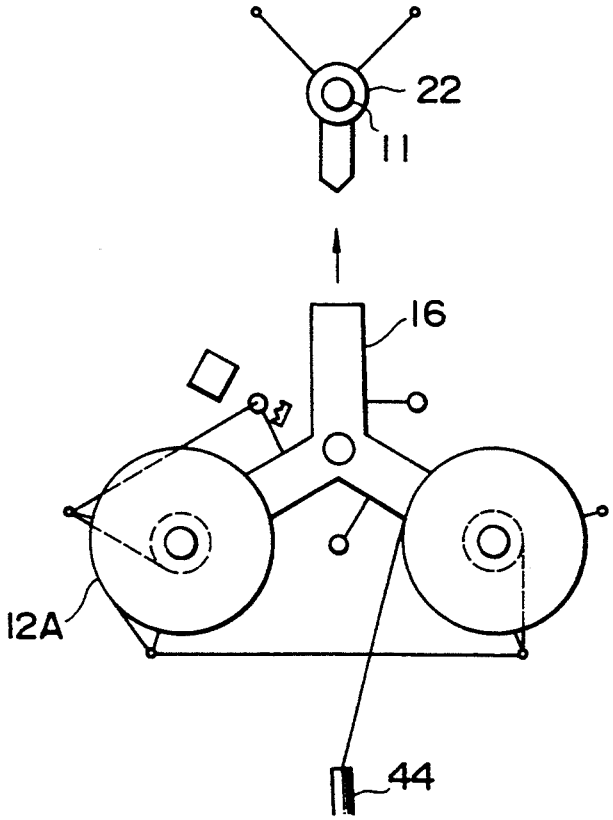
FIG. 35 is a schematic view showing a state in which a bobbin holder moved by the rotation of the rotary portion to the feeding position is upwardly transferred.
Figure 36:
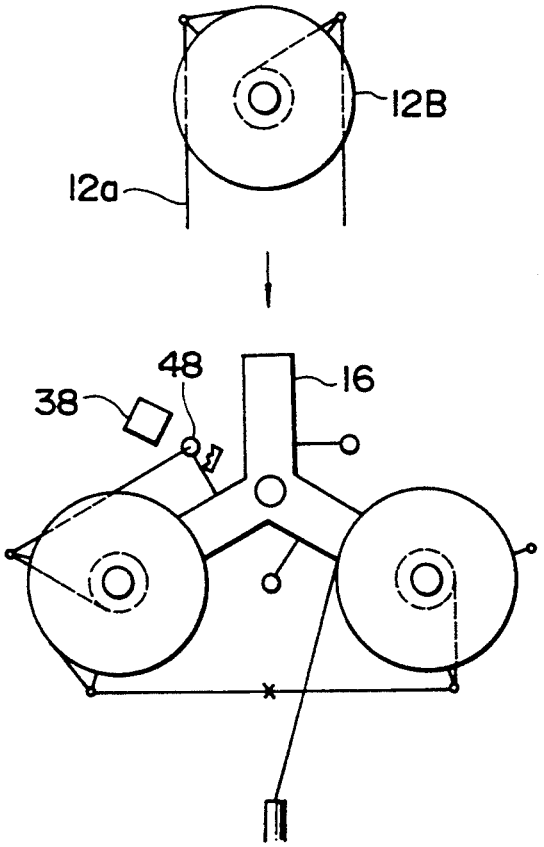
FIG. 36 is a schematic view showing a state in which a new weft package is lowered to be provided for the weft feeding means.

As shown in FIGS. 33 to 35, the rotary member 16 is rotated counterclockwise by 120 degrees while feeding the weft from the weft package 12 disposed at the waiting position. Accordingly, the bobbin holder 22 and the bobbin 11 disposed at the released position are moved to the feeding position. At the time, the suction pipe 48 sucking and holding the tail end 12b of the weft from the package 12A is rotated together with the rotary member 16 counterclockwise by 120 degrees to guide the tail end 12b ahead of the yarn guide 50. Concurrently, the suction pipe 48 is positioned in the vicinity of the movement locus of the leading end 12a of the weft from the package 12B which will be provided by the carrying means later (see FIGS. 36 and 37).

The other suction pipes 48 are similarly rotated to be positioned in the vicinity of the movement locus of the tail end 12b of the weft from the package 12B which will be provided later.

Thereafter, the carrying means is operated to recover the bobbin holder 22 and the bobbin 11, and a new weft package 12B is provided for the rotary member 16. When the weft package 12B is lowered and provided, the leading end 12a of the weft from the package 12B is drawn into the suction pipe 48 into which the tail end 12b of the weft from the package 12A is drawn. Further, the tail end 12b of the weft package 12B is drawn into another suction pipe 48.

Figure 38:
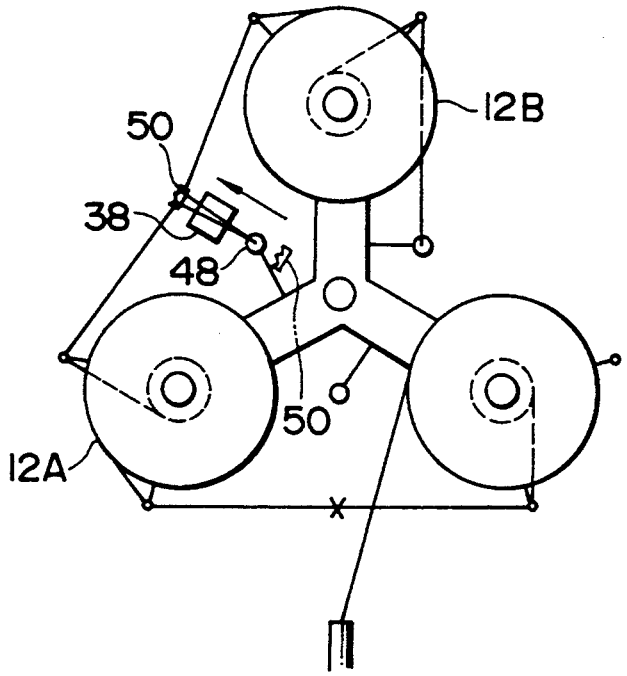
FIG. 38 is a schematic view showing a state in which both weft ends supported by the suction pipe are moved to a working area of a knotter by a yarn guide.
Figure 39:
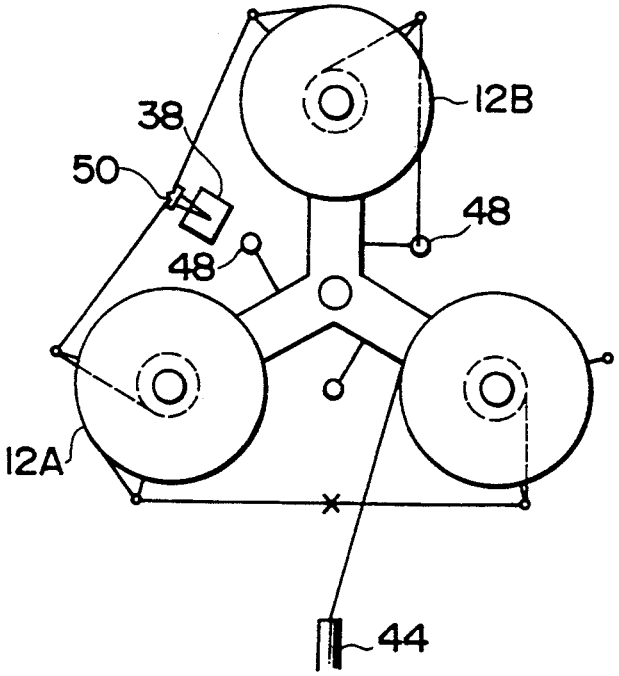
FIG. 39 is a schematic view showing a state in which the transfer tail is formed by the knotter.
Figure 40:
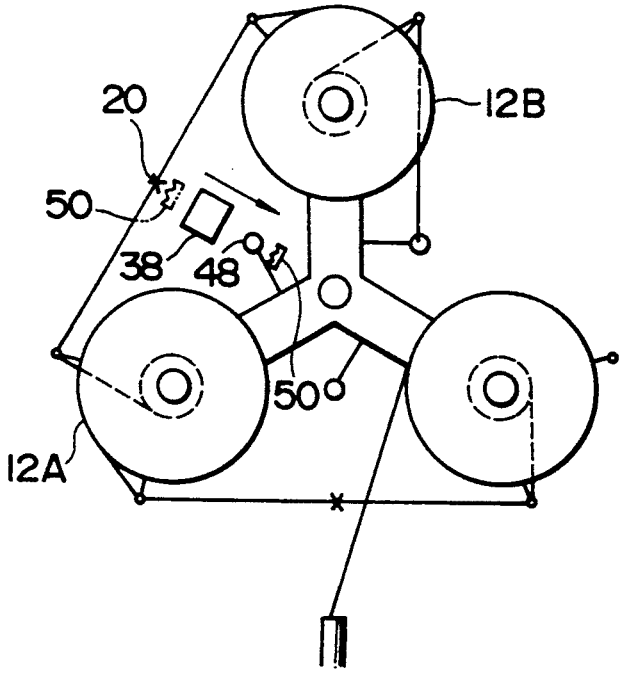
FIG. 40 is a schematic view showing a state in which the yarn guide is returned to the original position as shown in FIG. 30.

Next, both weft ends 12a and 12b held by the suction pipe 48 which are moved to the working area of the knotter 38 by the yarn guide 50 (see FIG. 38). The knotter 38 is operated to splice both weft ends 12a and 12b while both weft ends are disposed at the working area (see FIG. 39). After forming the transfer tail 20, the yarn guide 50 is returned to an original position, i.e., the same position as shown in FIG. 30 (see FIG. 40).

In the above embodiment, the suction pipes 48 are respectively arranged and mounted on the rotary member 16 between the mutually adjacent positions, i.e., between the feeding and the waiting positions, between the waiting and the released positions, and between the released and the feeding positions. However, the present invention should not be limited to such a construction in the embodiment. For example, two suction pipes may be arranged at a predetermined position between the feeding position and the waiting position, and at a predetermined position between the feeding position and the released position, respectively. Additionally, two suction pipes may be mounted movably in the mutually opposite directions between two predetermined positions independent of the rotary member 16 of the weft stand. Two predetermined positions as noted herein correspond to a position of the suction pipe disposed between the feeding position and the waiting position and a position of the suction pipe disposed between the feeding position and the released position, i.e., positions of these two suction pipes disposed at the upper positions.

In the transfer tail formation apparatus employing these suction pipes, when the weft of the weft package disposed at the released position is used, the tail end of the weft from the package disposed at the feeding position is sucked and held by one suction pipe disposed at the predetermined position between the feeding position and the released position. At the time, the other suction pipe is disposed at the predetermined position between the feeding position and the waiting position. In addition, no end is picked by the other suction pipe since the picked leading end and the tail end have been knotted together to form the transfer tail.

When the weft of the weft package at the released position is completely consumed, the weft is fed from the spare weft package through the transfer tail. Thereafter, the rotary member is rotated counterclockwise by 120 degrees. During the rotation, the one suction pipe is moved to the predetermined position where the other suction pipe has been positioned, while holding the tail end of the weft from the package.

Concurrently, the other pipe is moved to the predetermined position where the one suction pipe has been positioned. That is, both suction pipes exchange their positions.

The bobbin holder and the bobbin are recovered by the carrying means and a new weft package is provided for the rotary member. While the new weft package is lowered, the leading end of the weft from the new package is drawn into one suction pipe. Further, a tail end of the weft from the new package is drawn into the other suction pipe. Subsequently, both ends held by the one suction pipe are moved to the working area of the knotter by the yarn guide, and are knotted together by the operation of the knotter.

Referring now to FIGS. 41 to 50, a still further embodiment will be described hereinafter.

First suction pipes 52A, 52B and 52C are mounted on the rotary member 16 of the weft stand and are rotatable together with the weft package about the one axis. A second suction pipe 56 is mounted on the weaving machine and is movable toward the working area of the knotter 38.

The first suction pipes are respectively arranged between the mutually adjacent positions, i.e., between the feeding and the waiting positions, between the waiting and the released positions and between the feeding and the released positions. The knotter 38 is also movable toward the working area.

Figure 41:
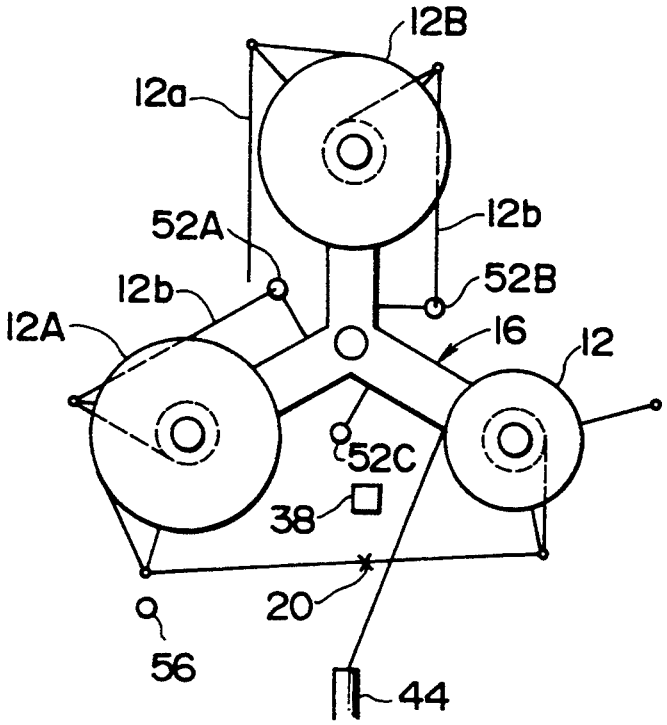
FIG. 41 is a schematic view showing a state in which three weft packages are held by the weft feeding means to feed the weft from the weft package disposed at a released position, and a tail end of weft from one package is sucked in a first suction pipe in a still further embodiment.

The first suction pipe is provided for drawing the tail end 12b of a weft from a new package when the new weft package is lowered to the feeding position to be provided for the weft stand. Specifically, the first suction pipe 52A is disposed between the feeding and waiting positions to pick up the weft end (tail end 12b) from the package 12A which is disposed at the waiting position as shown in FIG. 41. This is resulted from the fact that the tail end 12b is sucked by the first suction pipe 52A opened on or in the vicinity of the movement locus of the tail end 12b while the weft package 12A is lowered to the feeding position to be provided for the weft stand. At the time, the first suction pipe 52A corresponding to the tail end **12*b* of the weft from the package 12A** is positioned between the feeding position and the released position.

Moreover, as shown in FIG. 41, the first suction pipe 52B is positioned between the feeding position and the released position to pick up the end (tail end) **12*b* of the weft from the package 12B disposed at the feeding position. An opening end of the first suction pipe 52B is positioned on or in the vicinity of the movement locus of one end 12*b* of the weft from the package when providing the weft package 12B for the rotary member 16**.

On the other hand, the second suction pipe 56 is provided for picking the other end (leading end) **12*a* of the weft from the package 12B which is rotated together with the rotary member 16 to the waiting position. The second suction pipe 56 is arranged such that an opening end of the second suction pipe 56 is positioned on or in the vicinity of the rotation locus of the leading end 12*a* of the weft from the package 12B when the weft package 12B** is rotated about the one axis.

Figure 42:
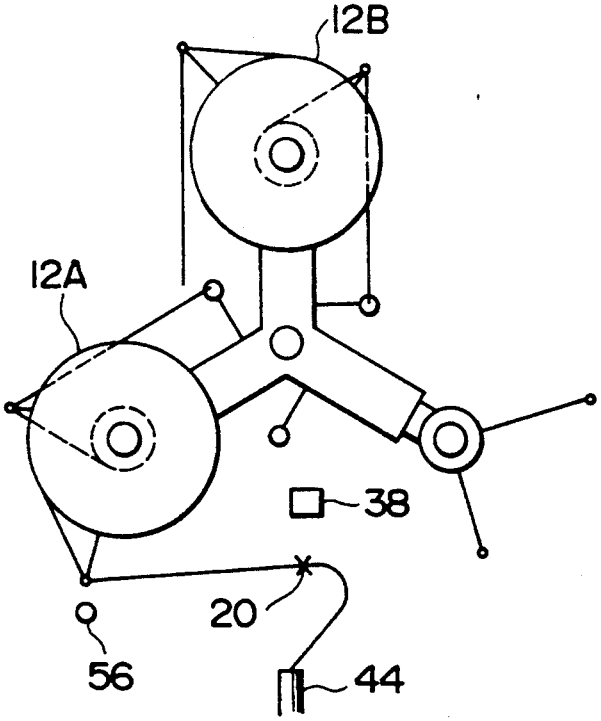
FIG. 42 is a schematic view showing a state in which the weft of the weft package disposed at the released position is consumed, and the weft package is being replaced with the weft package disposed at a waiting position as the feeding package of the weft.
Figure 43:
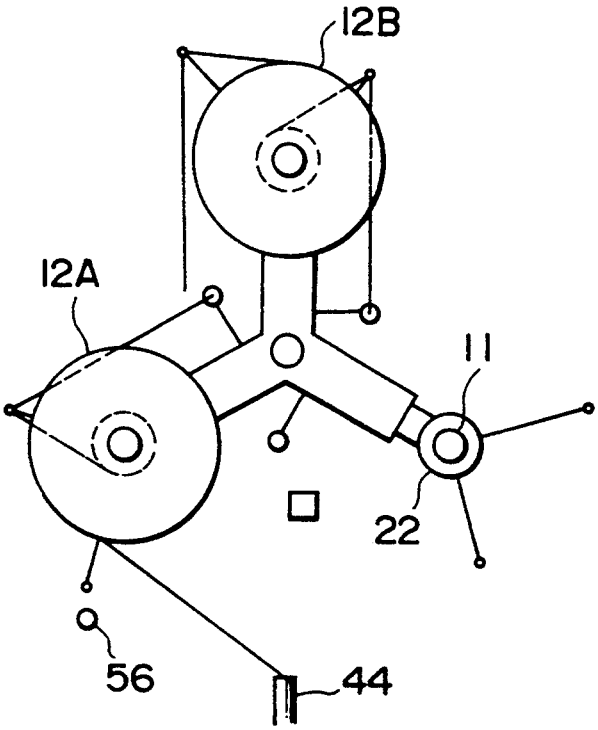
FIG. 43 is a schematic view showing a state in which the weft package disposed at the waiting position is serving as the feeding package of the weft.

As shown in FIGS. 41 to 43, when the weft of the weft package 12 disposed at the released position is consumed, the weft is fed through the transfer tail 20 from the spare weft package 12A which is disposed at the waiting position on the left-hand side of the released position.

Figure 44:
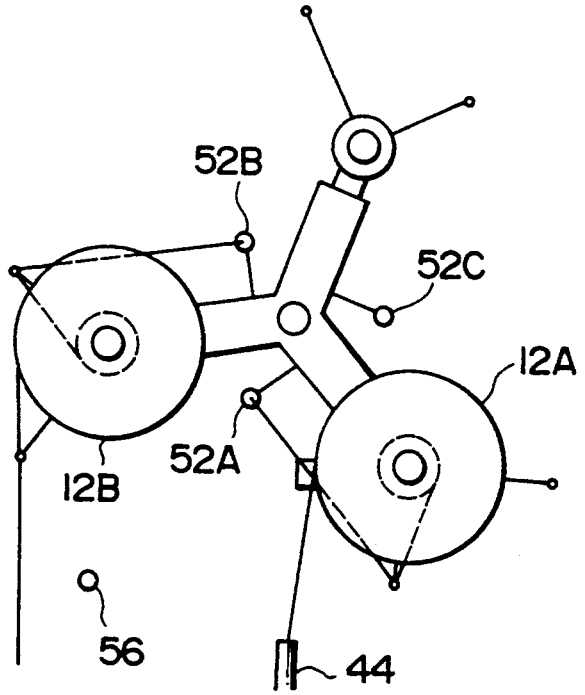
FIG. 44 is a schematic view showing a state in which a rotary portion of the weft feeding means is in the course of rotation.
Figure 45:
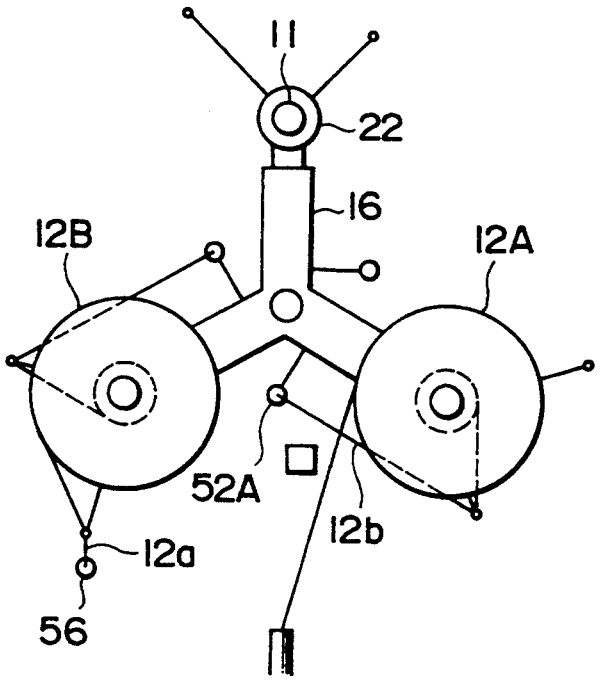
FIG. 45 is a schematic view showing a state in which the rotary portion is rotated by a rotation angle of 120 degrees, a leading end of weft from the other package is sucked into a second suction pipe, and the tail end sucked into the first suction pipe is positioned at a working area of a knotter.
Figure 46:
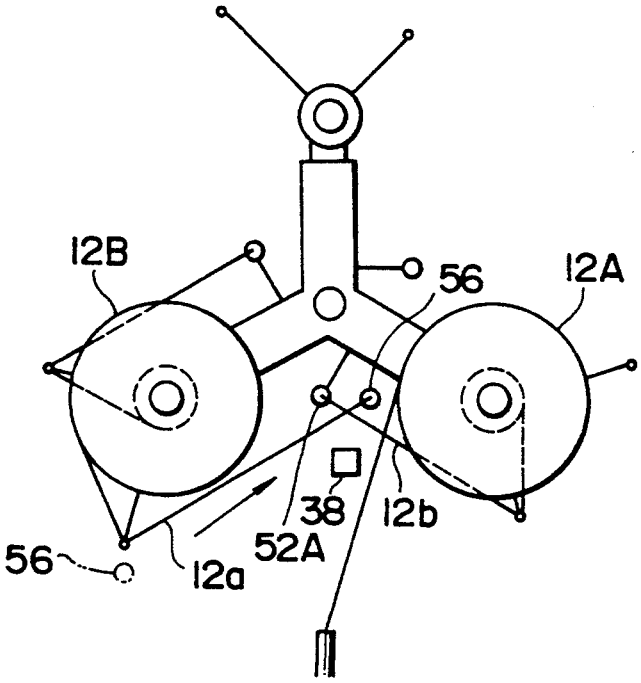
FIG. 46 is a schematic view showing a state in which the second suction pipe is moved so as to move the leading end held by the second suction pipe to the working area of the knotter.

As shown in FIGS. 44 and 45, the rotary member 16 is rotated counterclockwise by 120 degrees while feeding the weft from the weft package 12A disposed at the waiting position. Further, the bobbin holder 22 and the bobbin 11 disposed at the released position are moved to the feeding position. During the operation, the leading end **12*a* of the weft from the package 12B moved to the waiting position is sucked by the waiting second suction pipe 56. Moreover, when the weft package 12A is moved to the released position, the tail end 12*b* held by the first suction pipe 52A is partially positioned in the working area of the knotter 38 (see FIG. 45**).

Thereafter, the second suction pipe 56 is moved to the working area of the knotter 38. The leading end **12*a* held by the second suction pipe 56 intersects the tail end 12*b* held by the first suction pipe in the working area (see FIG. 46**).

Figure 47:
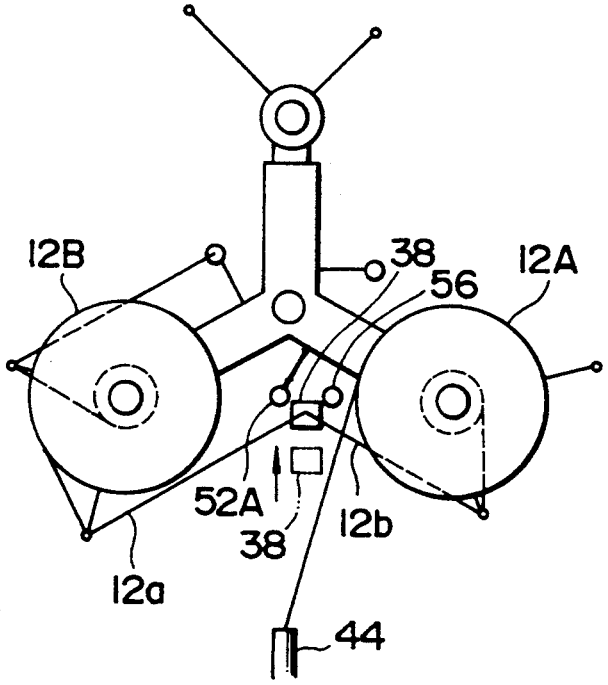
FIG. 47 is a schematic view showing a state in which the knotter is moved to the working area, and both the ends are spliced together.
Figure 48:
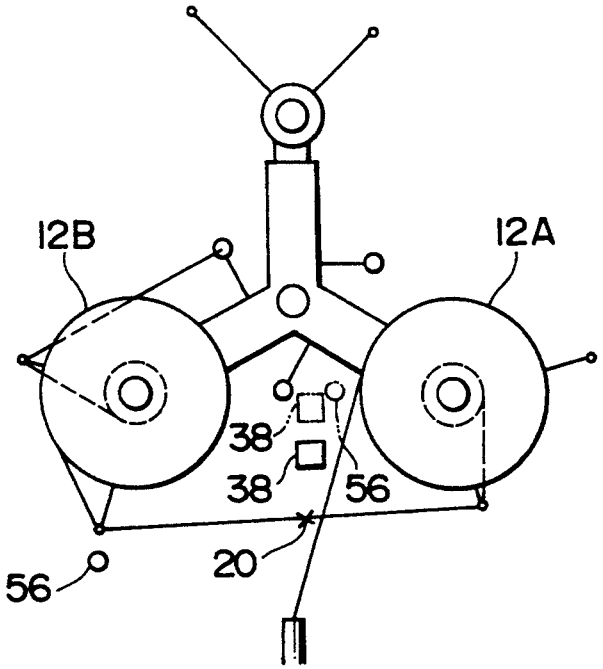
FIG. 48 is a schematic view showing a state in which the knotter is returned to an original position as shown in FIG. 36.
Figure 49:
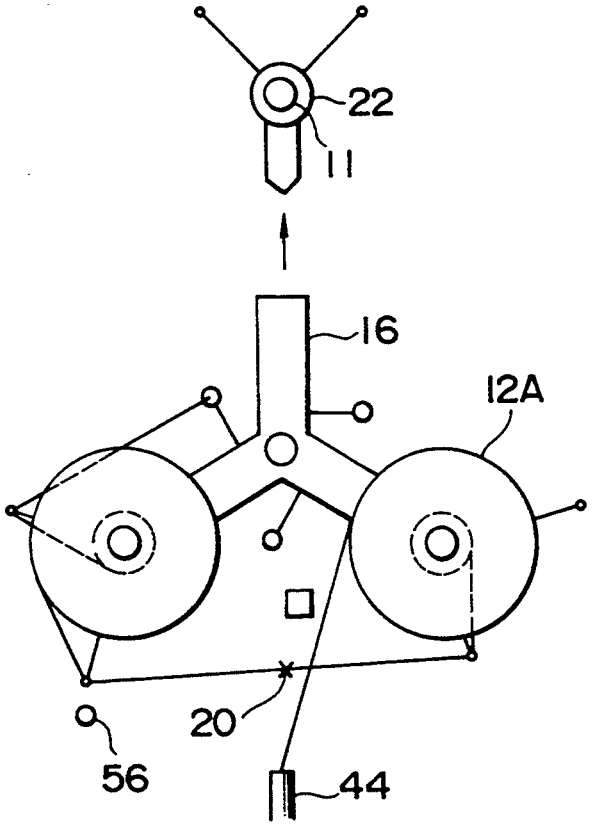
FIG. 49 is a schematic view showing a state in which a bobbin holder moved by the rotation of the rotary portion to a feeding position is upwardly transferred.

Subsequently, the knotter 38 is moved to the working area so that the knotter 38 can be operated to knot both ends **12*a* and 12*b* held by both suction pipes 52A and 56 together (see FIG. 47). After forming the transfer tail 20, the second suction pipe 56 and the knotter 38 are returned to original positions, i.e., the same positions as shown in FIG. 41 (FIG. 48**).

Figure 50:
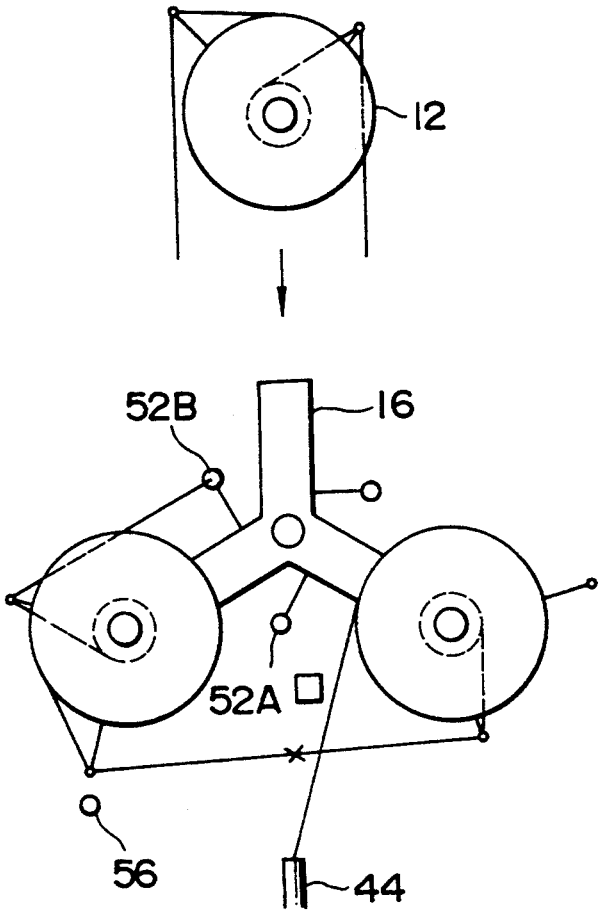
FIG. 50 is a schematic view showing a state in which a new weft package is lowered to be provided for the weft feeding means.

Thereafter, the carrying means is operated to recover a tray 22 and the bobbin 11 disposed at the feeding position (see FIG. 49), and a new weft package 12 is provided for the rotary member 16 at the feeding position after the recovery (FIG. 50).

In either of the embodiments, the weft package is rotated by the weft stand about one axis. However, another type of weft feeding means may be employed to move the weft package directly.

For example, the weft feeding means may comprise a belt conveyor horizontally disposed. The released position, the waiting position and the feeding position may be sequentially determined on an endless belt, and three weft packages may be adjacently mounted on these three positions.

Alternatively, the suction pipe serving as the catching means may be replaced with a grasping member comprising a pair of grasping bodies. The grasping member has an operating portion between the pair of grasping bodies at a time when the grasping member is opened. When the grasping member is employed as the catching means, the grasping member is arranged such that the operating portion thereof is positioned on the movement locus of the weft end. In the above embodiment, when the suction pipe and the end are relatively separated after the suction pipe has sucked the weft end therein, the end is partially drawn from the inside of the suction pipe. When the grasping member is employed as the catching means, the grasping member grasps the intermediate portion of the weft end. At the time, the intermediate portion may be flexibly grasped so as to separate the grasping member from the weft end relatively, and so as to release the weft end disposed between the pair of grasping bodies with the weft end positioned therebetween.

What is claimed is:

1. A transfer tail formation apparatus comprising:

a weft feeding means for feeding a weft to a weaving machine and including a rotary member for supporting and rotating weft packages;

a catching means provided in the vicinity of the rotary member for catching a tail end of a weft extending from one weft package supported by said rotary member and for catching a leading end of a weft extending from another weft package supported by said rotary member, wherein said catching means includes an operating portion in the vicinity of common movement loci of the tail end of said one weft package and the leading end of the other weft package when both the weft packages are supported and rotated by said rotary member; and a knotter for knotting both the ends caught by said catching means.

2. An apparatus according to claim 1, including a bobbin holder to which each said weft package is mounted, the bobbin holder being supported by the rotary member of said weft feeding means, the leading end and the tail end extending from each weft package being held by said bobbin holder to hang down.

3. An apparatus according to claim 1, wherein the operating portion of said catching means is movable toward said knotter.

4. A transfer tail formation apparatus comprising:

a weft feeding means disposed in the vicinity of a weaving machine for feeding a weft to the weaving machine and including a rotary member for supporting and rotating weft packages that are moved into supporting engagement with the rotary member;

first catching means and second catching means for respectively catching a leading end of a weft extending from one weft package and a tail end of a weft extending from another weft package, wherein said first catching means includes an operating portion in the vicinity of a movement locus of the leading end of said one weft package when the weft package is moved into supporting engagement with said rotary member, and wherein said second catching means includes an operating portion in the vicinity of a movement locus of the tail end of the other weft package when the weft package is supported and rotated by the rotary member; and a knotter for knotting both the ends caught by said first and second catching means.

5. An apparatus according to claim 4, including a bobbin holder to which each said weft package is mounted, the bobbin holder being supported by the rotary member of said weft feeding means, the leading end and the tail end extending from each weft package being held by said bobbin holder to hang down.

6. An apparatus according to claim 4, wherein the operating portions of said first and second catching means are respectively movable toward said knotter.

7. A transfer tail formation apparatus comprising:

a weft feeding means for feeding a weft to a weaving machine and including a rotary member for supporting and rotating weft packages that are moved from a first location to be fitted to the rotary member;

two catching means installed on said rotary member for catching a leading end and a tail end of a weft extending from a weft package, wherein said two catching means include operating portions positionable on or in the vicinity of movement loci of the leading end and the tail end as the weft package is moved to be fitted to the rotary member; and a knotter for knotting the tail end of one weft package supported and rotated by the rotary member and the leading end of another weft package supported by the rotary member, wherein both ends are caught by a different one of said two catching means.

8. An apparatus according to claim 7, wherein said weft packages are supported on the rotary member by a bobbin holder, and the leading end and the tail end extending from each weft package being held by said bobbin holder to hang down.

9. An apparatus according to claim 7, further comprising a yarn guide means for moving both ends caught by the first and second catching means toward the knotter.

10. A method of forming a transfer tail for connecting a leading end of weft of one weft package and a tail end of weft of another weft package, comprising the steps of:

applying suction force for drawing both ends of the weft;

catching both drawn ends; and connecting both caught ends with a knotter;

wherein the suction force is applied until both ends are connected by said knotter, and wherein the amount of suction force applied is as follows:

(suction force applied when drawing a weft end)≧

(suction force applied when connecting the ends)>

(suction force after drawing the weft end and before connecting the weft).

11. A transfer tail formation apparatus comprising:

a rotary member for receiving weft packages fed to the rotary member, wherein each package has a weft leading end and a weft tail end, and wherein the tail end defines a movement locus as the weft package is fed to the rotary member, the rotary member further supporting and rotating the weft package so that the leading end defines a movement locus upon rotation of the weft package;

first catching means installed on said rotary member and including an operating portion positionable in the vicinity of the movement locus of the tail end for catching the tail end;

second catching means provided in the vicinity of the rotary member and including an operating portion in the vicinity of the movement locus of a leading end of the weft package and for catching the leading end;

knotter means for knotting the caught leading end of one weft package with a caught tail end of another weft package.

12. An apparatus according to claim 11, wherein each weft package is mounted to a bobbin holder that is supported by the rotary member, and the leading end and the tail end extending from each weft package are held by said bobbin holder and hang down.

13. An apparatus according to claim 11, wherein the operating portions of said first and second catching means and said knotter are movable toward a working area of said knotter.

14. A transfer tail formation apparatus comprising:

a weft feeding means for feeding weft to a weaving machine and including a rotary member for supporting and rotating first and second weft packages that are successively fed to the rotary member, wherein each package has a weft leading end and a weft tail end, and wherein the tail end of the first package defines a first movement locus as the first package is rotated by the rotary member, and wherein the leading end of the second package defines a second movement locus as the second weft package is fed to the rotary member, and wherein the first and second movement loci substantially intersect;

a catching means provided in the vicinity of the intersection of the loci intersection for catching the tail end of the first weft package and the leading end of the second weft package; and a knotter for knotting both ends caught by said catching means.

15. A transfer tail formation apparatus comprising:

a weft feeding means for feeding weft to a weaving machine and including a rotary member for supporting and rotating first and second weft packages, wherein the tail end of the first package defines a first movement locus as the first package is rotated by the rotary member, and wherein the leading end of the second package defines a second movement locus as the second weft package is rotated by the rotary member;

catching means provided in the vicinity of the rotary member of said weft feeding means and including operating portions located in the vicinity of the first and second loci for catching the tail end of the first weft and for catching the leading end of the second weft; and a knotter for knotting both the ends caught by the catching means.

* * * * *